US010460864B2

(12) United States Patent
Choi

(10) Patent No.: US 10,460,864 B2
(45) **Date of Patent: *Oct. 29, 2019**

(54) MAGNETIC SUBSTANCE HOLDING DEVICE

(71) Applicant: Tae Kwang Choi, Gwangmyeong-si (KR)

(72) Inventor: Tae Kwang Choi, Gwangmyeong-si (KR)

( * ) Notice: Subject to any disclaimer, the term of this patent is extended or adjusted under 35 U.S.C. 154(b) by 326 days.

This patent is subject to a terminal disclaimer.

(21) Appl. No.: 15/411,364

(22) Filed: Jan. 20, 2017

(65) Prior Publication Data

US 2017/0133136 A1 May 11, 2017

Related U.S. Application Data

(63) Continuation of application No. 14/557,842, filed on Dec. 2, 2014, now Pat. No. 9,589,715.

(30) Foreign Application Priority Data

Jul. 4, 2014 (KR) ..... 10-2014-0083845
Oct. 1, 2014 (KR) ..... 10-2014-0132314

(51) Int. Cl.
*H01F 7/06* (2006.01)
*H01F 7/20* (2006.01)
(Continued)

(52) U.S. Cl.
CPC ..... *H01F 7/064* (2013.01); *H01F 7/0257* (2013.01); *H01F 7/04* (2013.01); *H01F 7/06* (2013.01); *H01F 7/206* (2013.01)

(58) Field of Classification Search
CPC ..... H01F 7/0257; H01F 7/04; H01F 7/064; H01F 7/206
(Continued)

(56) References Cited

U.S. PATENT DOCUMENTS 4,542,361 A 9/1985 Cavanagh
4,847,582 A 7/1989 Cardone et al.
(Continued)

FOREIGN PATENT DOCUMENTS

CN 101610873 A 12/2009
CN 103221179 A 7/2013
(Continued)

OTHER PUBLICATIONS

Chinese Office Action dated May 4, 2017 from SIPO in connection with the counterpart Chinese Patent Application No. 201580013885.1.
(Continued)

*Primary Examiner* — Bernard Rojas
(74) *Attorney, Agent, or Firm* — Hauptman Ham, LLP

(57) ABSTRACT

A magnetic substance holding device includes: a first pole piece assembly including a first N-pole piece, a first S-pole piece, and a first permanent magnet; a second pole piece assembly including a second N-pole piece, a second S-pole piece, and a second permanent magnet; at least one first coil; at least one second coil; and a control device controlling current applied to the first coil and the second coil so as to control magnetic fluxes passing through the first coil and the second coil, thereby allowing the first pole piece assembly and the second pole piece assembly to switch between the first arrangement and the second arrangement, to control magnetic fluxes passing through the holding faces of the first pole piece assembly and the second pole piece assembly.

3 Claims, 16 Drawing Sheets

(51) Int. Cl.
*H01F 7/02* (2006.01)
*H01F 7/04* (2006.01)

(58) Field of Classification Search
USPC ..... 335/285, 289, 290
See application file for complete search history.

(56) References Cited

U.S. PATENT DOCUMENTS

| | | | |
|---|---|---|---|
| 7,619,499 | B2 | 11/2009 | Wieler et al. |
| 7,782,164 | B2 | 8/2010 | Tiberghien et al. |
| 8,907,754 | B2 | 12/2014 | Barton et al. |
| 2007/0290780 | A1 | 12/2007 | Tiberghien et al. |
| 2010/0013583 | A1 | 1/2010 | Kimura |
| 2013/0135067 | A1 | 5/2013 | Choi |
| 2014/0361860 | A1 | 12/2014 | Choi |

FOREIGN PATENT DOCUMENTS

| | | | |
|---|---|---|---|
| JP | 2008-200927 | A | 9/2008 |
| KR | 1020120030993 | A | 3/2012 |
| KR | 1020120130040 | A | 11/2012 |
| KR | 10-1319052 | B1 | 10/2013 |
| KR | 101319052 | B1 | 10/2013 |

OTHER PUBLICATIONS

Office Action for KR application No. KR 10-2014-0132314 dated Nov. 13, 2014.
Decision for Grant of Patent for application No. KR10-2014-0132314 issued by KIPO, dated Feb. 25, 2015.

MAGNETIC SUBSTANCE HOLDING DEVICE

CROSS REFERENCE TO RELATED APPLICATION

This instant application is a continuation of U.S. patent application Ser. No. 14/557,842 filed on Dec. 2, 2014, which is the Nonprovisional application, which is based on and claims priorities to Korean Patent Applications No. 10-2014-0083845 filed on Jul. 4, 2014, and No. 10-2014-0132314 filed on Oct. 1, 2014. The disclosures of above-listed applications are hereby incorporated by reference herein by their entirety.

BACKGROUND OF THE INVENTION

Field of the Invention

The present invention relates to a magnetic substance holding device, and more particularly to a magnetic substance holding device that controls magnetic fluxes from permanent magnets to thereby obtain strong holding force, to easily switch between holding and detaching, and to minimize residual magnetism.

Description of the Related Art

A magnetic substance holding device such as a permanent magnet workholding device is used to attach thereto a workpiece made of a magnetic material such as iron using magnetic force. Nowadays, such a magnetic substance holding device is widely used as an internal device built in a mold clamping unit of an injection molding machine, a mold clamping unit of a press machine, a chuck of a machine tool, and so on.

The basic principle of such a magnetic substance holding device is that it attaches a magnetic workpiece to a holding face using strong magnetic force from a permanent magnet, and detaches the magnetic workpiece from the holding face by controlling the magnetic flux from the permanent magnet so that no magnetic flux flows through the holding face.

The method for controlling the magnetic flux from the permanent magnet may include rotating another permanent magnet which is rotatably installed to control the magnetic flux, employing an additional electromagnet to control the magnet flux, or the like.

The applicant of the present invention has already proposed a magnetic substance holding device employing an additional electromagnet (see International Publication No. WO 2012/039548). In addition, the applicant of the present invention has proposed an improved magnetic substance holding device (see Korean Patent No. 1319052).

The magnetic substance holding devices disclosed in the International Publication No. WO 2012/039548 and the Korean Patent No. 1319052 include coils around pole pieces instead of an additional electromagnet, and accordingly has advantages in that strong holding force can be obtained in a simple structure, magnetic force from a permanent magnet can be controlled with small current at the time of switching between holding and detaching, and strong holding force can be obtained in a smaller space.

However, there is still a challenge for such a magnet substance holding device to minimize residual magnetism that attracts a workpiece even after it is detached.

In short, as more permanent magnets are used for increasing holding force, it becomes more difficult to control magnetic fluxes and residual magnetism becomes lager, thereby harming the usability.

SUMMARY OF THE INVENTION

In view of the above, an object of the present invention is to provide a magnetic substance holding device that controls magnetic fluxes from permanent magnets to thereby obtain strong holding force, to easily switch between holding and detaching, and to minimize residual magnetism.

It should be noted that objects of the present invention are not limited to the above-mentioned object; and other objects of the present invention will be apparent to those skilled in the art from the following descriptions.

According to an aspect of the present invention, there is provided a magnetic substance holding device, comprising: a first pole piece assembly comprising a first N-pole piece having a holding face and a contact face and being a magnetic substance, a first S-pole piece having a holding face and a contact face and being a magnetic substance, and a first permanent magnet having an N-pole to be in contact with the first N-pole piece and an S-pole to be in contact with the first S-pole; a second pole piece assembly comprising a second N-pole piece having a holding face and a contact face and being a magnetic substance, a second S-pole piece having a holding face and a contact face and being a magnetic substance, and a second permanent magnet having an N-pole to be in contact with the second N-pole piece and an S-pole to be in contact with the second S-pole, wherein the contact face of the second S-pole piece faces the contact face of the first N-pole piece, and the contact face of the second N-pole piece faces the contact face of the first S-pole piece; at least one first coil disposed to affect a magnetic flux passing through the holding face of the first N-pole piece and/or a magnetic flux passing through the holding face of the second S-pole piece; at least one second coil disposed to affect a magnetic flux passing through the holding face of the first S-pole piece and/or a magnetic flux passing through the holding face of the second N-pole piece; and a control device controlling current applied to the first coil and the second coil. At least one of the first pole piece assembly and the second pole piece assembly is configured to be movable so that a first arrangement in which the contact face of the first N-pole piece is separated from the contact face of the second S-pole piece and the contact face of the first S-pole piece is separated from the contact face of the second N-pole piece, and a second arrangement in which the contact face of the first N-pole piece is in contact with the contact face of the second S-pole piece and the contact face of the first S-pole piece is in contact with the contact face of the second N-pole piece, are switched between each other. The control device adjusts current applied to the first coil and the second coil so as to control magnetic fluxes passing through the first coil and the second coil, thereby allowing the first pole piece assembly and the second pole piece assembly to switch between the first arrangement and the second arrangement, to control magnetic fluxes passing through the holding faces of the first pole piece assembly and the second pole piece assembly.

The magnetic substance holding device may further comprise: a first connection pole piece having a holding face and a contact face and being a magnetic substance; and a second connection pole piece having a holding face and a contact face and being a magnetic substance. The contact face of the first connection pole piece faces the holding face of the first N-pole piece, and the contact face of the second connection pole piece faces the holding face of the first S-pole piece. The first connection pole piece, the second connection pole piece and the second pole piece assembly are stationary whereas the first pole piece assembly is movable between the first/second connection pole pieces and the second pole piece assembly. The first connection pole piece and the second connection pole piece are arranged such that when the first pole piece assembly and the second pole piece assembly are in the first arrangement, the holding faces of the first pole piece assembly are in contact with the respective contact faces of the first connection pole piece and the second connection pole piece, and when the first pole piece assembly and the second pole piece assembly are in the second arrangement, the holding faces of the first pole piece assembly are separated from the respective contact faces of the first connection pole piece and the second connection pole piece. When the first pole piece assembly and the second pole piece assembly are in the first arrangement, magnetic workpieces are held on the holding faces of the second pole piece assembly and on the holding faces of the first connection pole piece and the second connection pole piece, respectively, and when the first pole piece assembly and the second pole piece assembly are in the second arrangement, magnetic workpieces are detached from the holding faces of the second pole piece assembly and from the holding faces of the first connection pole piece and the second connection pole piece, respectively.

The magnetic substance holding device may further comprise: a third pole piece assembly comprising a third N-pole piece having a holding face and a contact face and being a magnetic substance, a third S-pole piece having a holding face and a contact face and being a magnetic substance; and a third permanent magnet having an N-pole to be in contact with the third N-pole piece and an S-pole to be in contact with the third S-pole piece. The contact face of the third S-pole piece is arranged to face the holding face of the first N-pole piece, and the contact face of the third N-pole piece is arranged to face the holding face of the first S-pole piece. The second pole piece assembly and the third pole piece assembly are stationary whereas the first pole piece assembly is movable between the second pole piece assembly and the third pole piece assembly. The third pole piece assembly is arranged such that when the first pole piece assembly and the second pole piece assembly are in the first arrangement, the holding faces of the first pole piece assembly are in contact with the respective contact faces of the third pole piece assembly, and when the first pole piece assembly and the second pole piece assembly are in the second arrangement, the holding faces of the first pole piece assembly are separated from the respective contact faces of the third pole piece assembly. When the first pole piece assembly and the second pole piece assembly are in the first arrangement, a magnetic workpiece is held on the holding faces of the second pole piece assembly whereas a magnetic workpiece is detached from the holding faces of the third pole piece assembly, and when the first pole piece assembly and the second pole piece assembly are in the second arrangement, a magnetic workpiece is detached from the holding faces of the second pole piece assembly whereas a magnetic workpiece is held on the holding faces of the third pole piece assembly.

The holding face of the first connection pole piece, the holding face of the second connection pole piece and the holding faces of the second pole piece assembly may be configured to attach a single workpiece.

The first pole piece assembly may be movable along a plane extended from the holding faces of the second pole piece assembly and the holding faces of the first connection pole piece and the second connection pole piece.

The holding faces of the second pole piece assembly, the holding face of the first connection pole piece and the holding face of the second connection pole piece may be arranged in a quadrangular shape.

The holding faces of the second pole piece assembly may be arranged adjacent to each other, and the holding face of the first connection pole piece and the holding face of the second connection pole piece may be arranged adjacent to each other.

The magnetic substance holding device may further comprise: a third connection pole piece having a holding face and a contact face and being a magnetic substance; and at least one third coil. The second connection pole piece has two holding faces, and the first pole piece assembly further comprises a third N-pole piece having a holding face and a contact face and being a magnetic substance, and a third permanent magnet having an S-pole to be in contact with the first S-pole piece and an N-pole to be in contact with the third N-pole piece. The second pole piece assembly further comprises a third S-pole piece having a holding face and a contact face and being a magnetic substance, and a fourth permanent magnet having an N-pole to be in contact with the second N-pole piece and an S-pole to be in contact with the third S-pole piece. The third coil is disposed to affect a magnetic flux passing through the holding face of the third N-pole piece and/or a magnetic flux passing through the holding face of the third S-pole piece. The first connection pole piece, the second connection pole piece and the third connection pole piece are arranged such that if the first pole piece assembly and the second pole piece assembly are in the first arrangement, the holding faces of the first pole piece assembly are in contact with the respective contact faces of the first connection pole piece, the second connection pole piece and the third connection pole piece, and if the first pole piece assembly and the second pole piece assembly are in the second arrangement, the holding faces of the first pole piece assembly are separated from the respective contact faces of the first connection pole piece, the second connection pole piece and the third connection pole piece. The holding faces of the second pole piece assembly, the holding face of the first connection pole piece, the holding faces of the second connection pole piece and the holding face of the third connection pole piece are configured to attach a single magnetic workpiece. When the first pole piece assembly and the second pole piece assembly are in the first arrangement, the workpiece is held on the holding faces of the second pole piece assembly, the holding face of the first connection pole piece, the holding faces of the second connection pole piece and the holding face of the third connection pole piece, and when the first pole piece assembly and the second pole piece assembly are in the second arrangement, the workpiece is detached from the holding faces of the second pole piece assembly, the holding face of the first connection pole piece, the holding faces of the second connection pole piece and the holding face of the third connection pole piece. One of the holding faces of the second connection pole piece is adjacent to the holding face of the first connection pole piece and the other one of the holding faces of the second connection pole piece is adjacent to the holding face of the third connection pole piece. The control device adjusts current applied to the first coil, the second coil and the third coil to control magnetic fluxes passing through the first coil, the second coil and the third coil, thereby allowing the first pole piece assembly and the second pole piece assembly to switch between the first arrangement and the second arrangement, to control magnetic fluxes passing through the holding face of the first pole piece assembly, the holding face of the second pole piece assembly, the holding face of the first connection pole piece, the holding face of the second connection pole piece and the holding face of the third connection pole piece.

The holding face of the second connection pole piece may be formed on an end of a projection, and the second coil may be disposed around the projection.

The first pole piece assembly may further comprise a first reinforcement pole piece arranged to surround its N-pole piece and S-pole piece and being a magnetic substance, at least one first reinforcement permanent magnet having an S-pole to be in contact with the first reinforcement pole piece and an N-pole to be in contact with the N-pole piece, and at least one second reinforcement permanent magnet having an N-pole to be in contact with the first reinforcement pole piece and an S-pole to be in contact with the S-pole piece, and/or the second pole piece assembly may further comprise a second reinforcement pole piece arranged to surround its N-pole piece and S-pole piece and being a magnetic substance, at least one third reinforcement permanent magnet having S-pole to be in contact with the second reinforcement pole piece and an N-pole to be in contact with the N-pole piece, and at least one fourth reinforcement permanent magnet having an N-pole to be in contact with the second reinforcement pole piece and an S-pole to be in contact with the S-pole piece.

The first pole piece assembly may further comprise a first auxiliary N-pole piece, a first auxiliary S-pole piece, a first reinforcement permanent magnet having an N-pole to be in contact with the first auxiliary N-pole piece and an S-pole to be in contact with the first auxiliary S-pole piece, a second reinforcement permanent magnet having an N-pole to be in contact with the first auxiliary N-pole piece and an S-pole to be in contact with the S-pole piece, and a third reinforcement permanent magnet having an S-pole to be in contact with the first auxiliary S-pole piece and an N-pole to be in contact with the N-pole piece, and/or the second pole piece assembly may further comprise a second auxiliary N-pole piece, a second auxiliary S-pole piece, a fourth reinforcement permanent magnet having an N-pole to be in contact with the second auxiliary N-pole piece and an S-pole to be in contact with the second auxiliary S-pole piece, a fifth reinforcement permanent magnet having an N-pole to be in contact with the second auxiliary N-pole piece and an S-pole to be in contact with the S-pole piece, and a sixth reinforcement permanent magnet having an S-pole to be in contact with the second auxiliary S-pole piece and an N-pole to be in contact with the N-pole piece.

The first coil may be disposed around the first N-pole piece and/or the second S-pole piece, and the second coil may be disposed around the first S-pole piece and/or the second N-pole piece. The first coil and the second coil are not disposed between the first permanent magnet and the second permanent magnet.

Cross-sectional areas of the pole pieces through which a magnetic flux passes when the first pole piece assembly and the second pole piece assembly are in the second arrangement may be larger than cross-sectional areas of the first connection pole piece and the second connection pole piece.

Cross-sectional areas of the pole pieces through which a magnetic flux passes when the first pole piece assembly and the second pole piece assembly are in the second arrangement may be larger than cross-sectional areas of pole pieces between the second permanent magnet and the holding faces of the second pole piece assembly.

Cross-sectional areas of the pole pieces through which a magnetic flux passes when the first pole piece assembly and the second pole piece assembly are in the second arrangement may be larger than cross-sectional areas of pole pieces between the first permanent magnet and the holding faces of the first pole piece assembly.

The first coil and the second coil may be disposed between the second permanent magnet and the holding faces of the second pole piece assembly.

The first coil and the second coil may be disposed between the first permanent magnet and the holding faces of the first pole piece assembly.

The first pole piece assembly or the second pole piece assembly, whichever is movable, may be guided by a headless bolt.

The first connection pole piece and the second connection pole piece may have chamfered or filleted corners so that a shortest path via which a magnetic flux passing through the first connection pole piece and the second connection pole piece is not bent at a right angle.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1A:
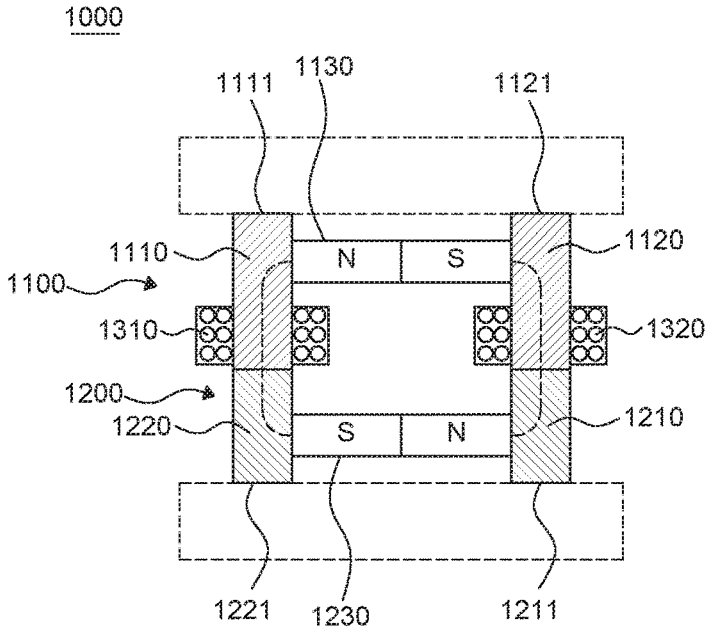
FIGS. 1A to 1C are schematic cross-sectional views of a magnetic substance holding device according to an exemplary embodiment of the present invention.

Advantages and features of the present invention and methods to achieve them will become apparent from the descriptions of exemplary embodiments herein below with reference to the accompanying drawings. However, the present invention is not limited to exemplary embodiments disclosed herein but may be implemented in various different forms. The exemplary embodiments are provided for making the disclosure of the present invention thorough and for fully conveying the scope of the present invention to those skilled in the art. It is to be noted that the scope of the present invention is defined only by the claims.

As used herein, a phrase "an element A on an element B" refers to that the element A may be disposed directly on the element B and/or the element A may be disposed indirectly on the element B via another element C.

Terms such as first, second, etc. are used to distinguish arbitrarily between the elements such terms describe and these terms are not necessarily intended to indicate temporal or other prioritization of such elements. Accordingly, as used herein, a first element may be a second element within the technical scope of the present invention.

Like reference numerals denote like elements throughout the descriptions.

The drawings are not to scale and the relative dimensions of various elements in the drawings are depicted schematically and not necessarily to scale.

Features of various exemplary embodiments of the present invention may be coupled or combined partially or totally. As will be easily appreciated by those skilled in the art, technically various interactions and operations are possible. Various exemplary embodiments can be practiced individually or in combination.

At first, the basic configuration and operating principle of a magnetic substance holding device of the present invention will be described with reference to FIGS. 1A to 1C.

Figure 1B:
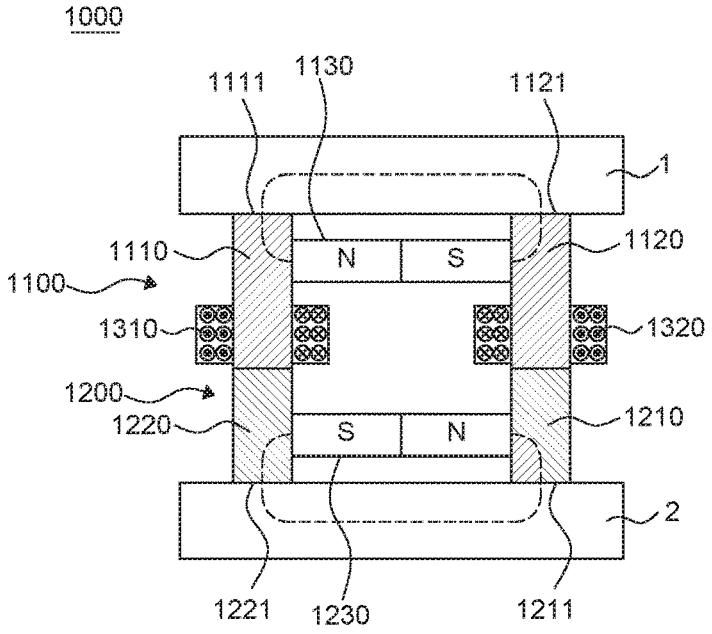
Figure 1C:
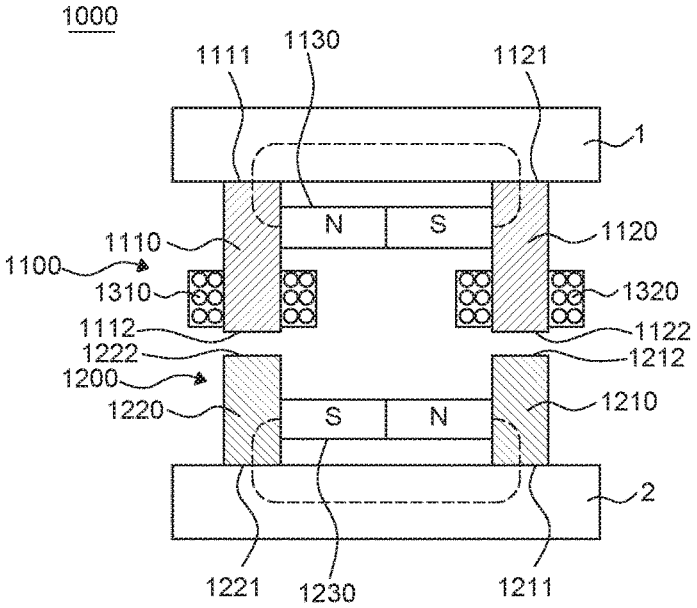

FIGS. 1A to 1C are schematic cross-sectional views of a magnetic substance holding device according to an exemplary embodiment of the present invention. Specifically, FIG. 1A is a schematic cross-sectional view of the magnetic substance holding device when workpieces are detached therefrom, whereas FIGS. 1B and 1C are schematic cross-sectional views of the magnetic substance holding device when it holds workpieces.

Referring to FIGS. 1A to 1C, the magnetic substance holding device 1000 includes a first pole piece assembly 1100, a second pole piece assembly 1200, a first coil 1310, a second coil 1320, and a control device (not shown).

The first pole piece assembly 1100 includes a first N-pole piece 1110, a first S-pole piece 1120, and a first permanent magnet 1130. The first N-pole piece 1110 is a magnetic substance having a holding face 1111 and a contact face 1112. The first S-pole piece 1120 is a magnetic substance having a holding face 1121 and a contact face 1122. The N-pole of the first permanent magnet 1130 comes in contact with the first N-pole piece 1110 while the S-pole of the first permanent magnet 1130 comes in contact with the first S-pole piece 1120.

The second pole piece assembly 1200 includes a second N-pole piece 1210, a second S-pole piece 1220, and a second permanent magnet 1230. The second N-pole piece 1210 is a magnetic substance having a holding face 1211 and a contact face 1212. The second S-pole piece 1220 is a magnetic substance having a holding face 1221 and a contact face 1222. The N-pole of the second permanent magnet 1230 comes in contact with the second N-pole piece 1210 while the S-pole of the second permanent magnet 1230 comes in contact with the second S-pole piece 1120.

The first pole piece assembly 1100 and the second pole piece assembly 1200 are arranged so that the contact face 1222 of the second S-pole piece 1220 can come in contact with and be separated from the contact face 1112 of the first N-pole piece 1110 (i.e., they face each other) while the contact face 1212 of the second N-pole piece 1210 can come in contact with and be separated from the contact face 1122 of the first S-pole piece 1120 (i.e., they face each other).

The first coil 1310 is disposed so that it affects at least one of a magnetic flux passing through the holding face 1111 of the first N-pole piece 1110 and a magnetic flux passing through the holding face 1121 of the second S-pole piece 1220. The second coil 1320 is disposed so that it affects at least one of a magnetic flux passing through the holding face 1121 of the first S-pole piece 1120 and a magnetic flux passing through the holding face 1211 of the second N-pole piece 1210.

The first coil 1310 and the second coil 1320 are wound around magnetic substances, respectively, and affect magnetic fluxes by magnetizing the magnetic substances upon application of current. The first coil 1310 is disposed to affect a magnetic flux passing through the holding faces 1111 and 1221, and the second coil 1320 is disposed to affect a magnetic flux passing through the holding faces 1121 and 1211. The first coil 1310 and/or the second coil 1320 may be disposed 1) between the first permanent magnet 1130 and the second permanent magnet 1230 as shown in FIGS. 1A to 1C, 2) around the N-pole pieces 1110 and 1210 or the S-pole pieces 1120 and 1220 on outer sides of the first permanent magnet 1130 and the second permanent magnet 1230, or 3) around pole pieces located on outer sides of the holding faces 1111, 1121, 1211 and 1221, other than the pole pieces 1110, 1120, 1210 and 1220. Namely, the first coil 1310 and the second coil 1320 may be wound around parts of the first pole piece assembly 1100 and the second pole piece assembly 1200, respectively, or may be wound around other parts on outer sides thereof.

Although one first coil 1310 and one second coil 1320 are shown in FIGS. 1A to 1C, two or more first coils and two or more second coils may be provided.

The first coil 1310 and the second coil 1320 are connected to the control device. The control device controls (the direction or amplitude of) current applied to the first coil 1310 and the second coil 1320. As used herein, current refers to direct current (DC).

At least one of the first pole piece assembly 1100 and the second pole piece assembly 1200 is movable so that a first arrangement in which the contact face 1112 of the first N-pole piece 1110 is separated from the contact face 1222 of the second S-pole piece 1220 and the contact face 1122 of the first S-pole piece 1120 is separated from the contact face 1212 of the second N-pole piece 1210 (as shown in FIG. 1C), and a second arrangement in which the contact face 1112 of the first N-pole piece 1110 comes in contact with the contact face 1222 of the second S-pole piece 1220 and the contact face 1122 of the first S-pole piece 1120 comes in contact with the contact face 1212 of the second N-pole piece 1210 (as shown in FIGS. 1A and 1B) are switched between each other. Specifically, only the first pole piece 1100, only the second pole piece 1200, or both the first and second pole pieces 1100 and 1200 may be movable. In the following descriptions, only the first pole piece assembly 1100 is movable in exemplary embodiments for the sake of convenience in description. However, it is to be understood that the present invention is not limited thereto.

A mechanism to move the first pole piece assembly 1100 or the second pole piece assembly 1200 may be any one known in the art. For example, a mechanism to move them with guide pins respectively inserted therein, a mechanism to move them with rollers, etc. may be employed without any particular limitation. The mechanism will be described below in detail.

The control device adjusts (the direction or amplitude of) current applied to the first coil 1310 and the second coil 1320 to thereby control the direction and the intensity of magnetic fluxes passing through the first coil 1310 and the second coil 1320.

Referring to FIG. 1A, when the first pole piece assembly 1100 and the second pole piece assembly 1200 are in the second arrangement in which they are in contact with each other, with no current supply from the control device to the first coil 1310 and the second coil 1320, a magnetic flux flows inside the magnetic circuit through the contact faces 1112, 1122, 1212 and 1222, as indicated by the dashed line. In this instance, almost no magnetic flux passes through the holding faces 1111, 1121, 1211 and 1221. The smaller a difference in magnetic forces (magnetic energies) between the first permanent magnet 1130 and the second permanent magnet 1230 is, the less magnetic flux flows through the holding faces 1111, 1121, 1211 and 1221. Therefore, in the arrangement shown in FIG. 1A, workpieces are not held on the holding faces 1111, 1121, 1211 and 1221 (Throughout the drawings, workpieces that are not held by the device are indicated by dashed lines).

On the other hand, when the control device applies current to the first coil 1310 and the second coil 1320 as shown in FIG. 1B, the magnetic flux between the first permanent magnet 1130 and the second permanent magnet 1230 through the contact faces 1112, 1122, 1212 and 1222 becomes weak and is eventually disconnected. At this time, by making workpieces 1 and 2, which are magnetic substances, in contact with the holding faces 1111 and 1121 and the holding faces 1211 and 1221, respectively, magnetic fluxes passing through the workpieces 1 and 2 are formed as indicated by the dashed lines in FIG. 1B. Accordingly, the workpieces 1 and 2 are held on the holding faces 1111 and 1121 and the holding faces 1211 and 1221, respectively.

Then, as shown in FIG. 1C, the magnetic fluxes once formed through the workpieces 1 and 2 are not broken but remains even if current is no more applied to the first coil 1310 and the second coil 1320. Further, since no magnetic flux is formed passing through the contact faces 1112, 1122, 1212 and 1222, the first pole piece assembly 1100 and the second pole piece assembly 1200 can be separated from each other.

In order to detach the workpieces 1 and 2 from the first pole piece assembly 1100 and the second pole piece assembly 1200, by applying current in the opposite direction to that of FIG. 1B to the first coil 1310 and the second coil 1320, the first pole piece assembly 1110 and the second pole piece assembly 1200 go back in the second arrangement as shown in FIG. 1A to thereby restore the magnetic flux shown in FIG. 1A.

In short, the control device adjusts current applied to the first coil 1310 and the second coil 1320 to thereby control the direction and intensity of the magnetic fluxes passing through the first coil 1310 and the second coil 1320. By doing so, the first pole piece assembly 1100 and the second pole piece assembly 1200 can be switched between the first arrangement and the second arrangement, and the direction and intensity of the magnetic fluxes passing through the holding faces 1111, 1121, 1211 and 1211 of the first pole piece assembly 1100 and the second pole piece assembly 1200 can be controlled. As a result, the workpieces 1 and 2, which are magnetic substances, can be attached to and detached from the holding faces 1111, 1121, 1211 and 1221.

Referring back to FIG. 1A, when the workpieces are detached from the magnetic substance holding device 1000 thus configured, the magnetic fluxes from the permanent magnets 1130 and 1230 flow only inside the magnetic circuit, so that it is possible to leave almost zero or completely no residual magnetism outside the device. (This effect can be maximized when the first permanent magnet 1130 and the second permanent magnet 1230 have the equal magnetic force (magnetic energy).) Further, in this structure, permanent magnets can be placed closely together, and thus stronger holding force can be obtained. Moreover, it is possible to hold workpieces on two sides, and accordingly various embodiments can be practiced.

Hereinafter, various exemplary embodiments which are modifications of the structure shown in FIGS. 1A to 1C will be described.

Figure 2A:
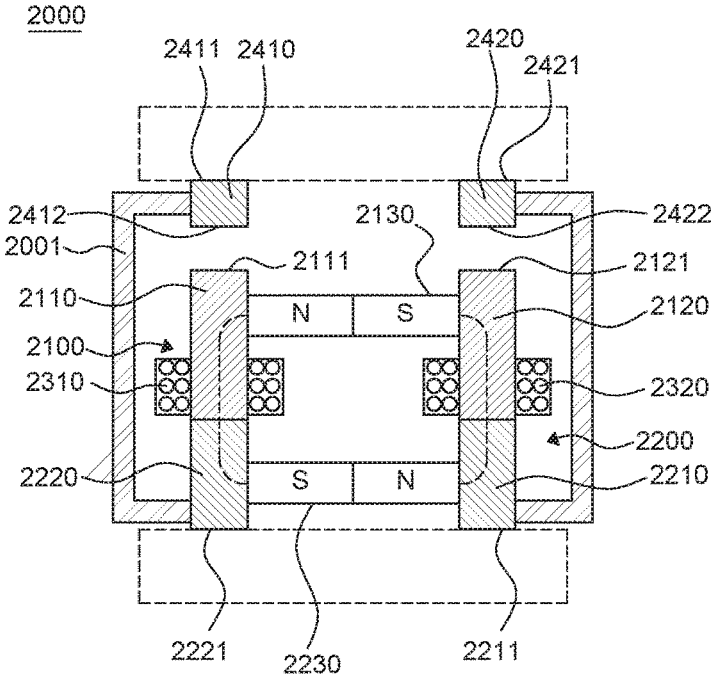
FIGS. 2A to 2C are schematic cross-sectional views of a magnetic substance holding device according to another exemplary embodiment of the present invention.
Figure 2B:
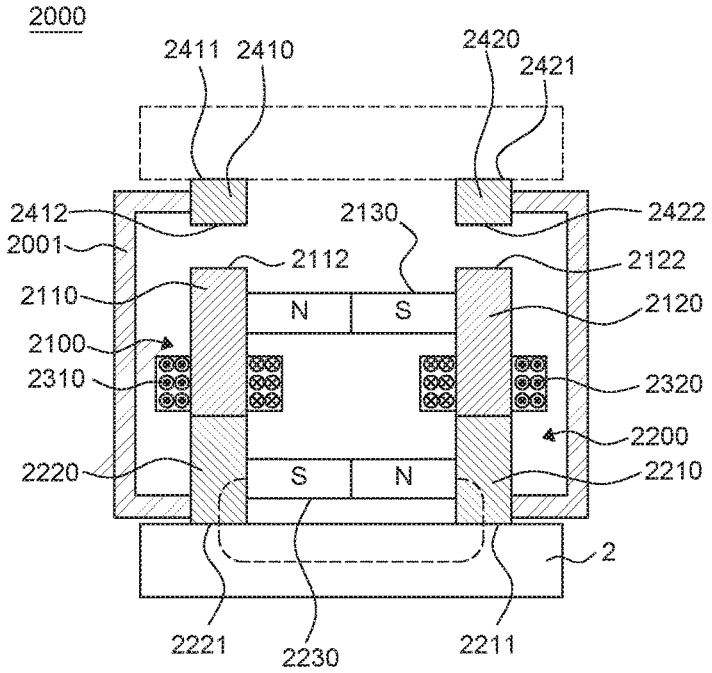
Figure 2C:
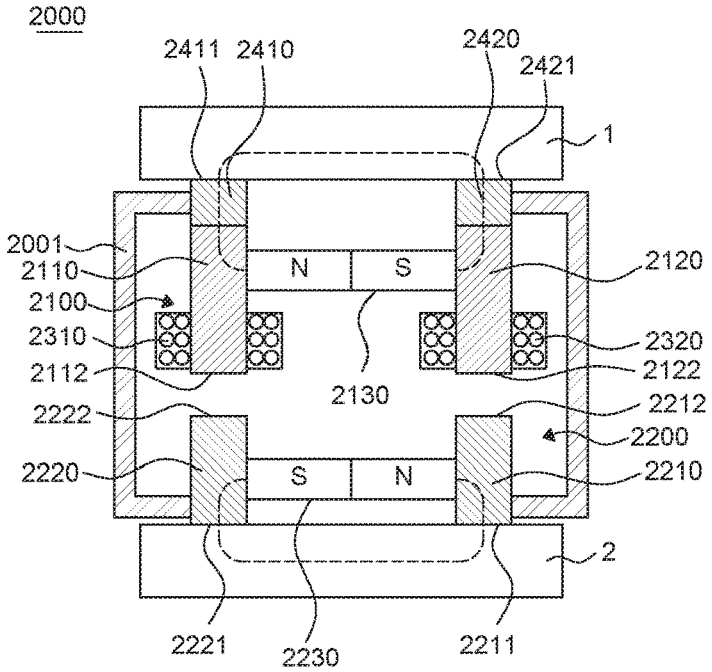

FIGS. 2A to 2C are schematic cross-sectional views of a magnetic substance holding device according to another exemplary embodiment of the present invention. Specifically, FIG. 2A is a schematic cross-sectional view of the magnetic substance holding device when workpieces are detached therefrom, whereas FIGS. 1B and 1C are schematic cross-sectional views of the magnetic substance holding device when it holds workpiece(s).

Referring to FIGS. 2A to 2C, the magnetic substance holding device 2000 according to this exemplary embodiment includes a first pole piece assembly 2100, a second pole piece assembly 2200, a first coil 2310, a second coil 2320, a first connection pole piece 2410, a second connection pole piece 2420, and a control device (not shown).

The first pole piece assembly 2100, the second pole piece assembly 2200, the first coil 2310 and the second coil 2320 are identical to the first pole piece assembly 1100, the second pole piece assembly 1200, the first coil 1310 and the second coil 1320 shown in FIGS. 1A to 1C; and, therefore, redundant descriptions thereon will be omitted.

The first connection pole piece 2410 has a holding face 2411 and a contact face 2412 and is a magnetic substance. The second connection pole piece 2420 has a holding face 2421 and a contact face 2422 and is a magnetic substance.

The first pole piece assembly 2100 is movable in the vertical direction of FIGS. 2A to 2C, whereas the second pole piece assembly 2200 is stationary. However, both the first pole piece assembly 2100 and the second pole piece assembly 2200 may be movable in the vertical direction.

For a first arrangement in which the first pole piece assembly 2100 is separated from the second pole piece assembly 2200 (the arrangement shown in FIG. 2C), the first connection pole piece 2410 and the second connection pole piece 2420 are arranged such that the holding faces 2111 and 2121 of the first pole piece assembly 2100 come in contact with the contact face 2412 of the first connection pole piece 2410 and the contact face 2422 of the second connection pole piece 2420, respectively. For a second arrangement in which the first pole piece assembly 2100 comes in contact with the second pole piece assembly 2200 (the arrangement shown in FIGS. 2A and 2B), the first connection pole piece 2410 and the second connection pole piece 2420 are arranged such that the holding faces 2111 and 2121 of the first pole piece assembly 2100 are separated from the contact face 2410 of the first connection pole piece 2410 and the contact face 2422 of the second connection pole piece 2420, respectively.

In this exemplary embodiment, the first connection pole piece 2410, the second connection pole piece 2420, and the second pole piece assembly 2200 are stationary and may be covered by a cover 2001 which is a non-magnetic substance.

Referring to FIG. 2A, when the first pole piece assembly 2100 and the second pole piece assembly 2200 are in the second arrangement, with no current supply to the first coil 2310 and the second coil 2320, a magnetic flux flows inside the magnetic circuit in the first pole piece assembly 2100 and the second pole piece assembly 2200 and does not pass through the holding faces 2111, 2121, 2211 and 2221, and thus workpieces are held on neither the upper side nor the lower side.

Then, as shown in FIG. 2B, when current is applied to the first coil 2310 and the second coil 2320, the magnetic flux between the first pole piece assembly 2100 and the second pole piece assembly 2200 is disconnected, and a magnetic flux passing through the holding faces 2211 and 2211 of the second pole piece assembly 2200 becomes strong, so that a workpiece 2 can be held on the side of the second pole piece assembly 2200. On the contrary, since the first pole piece assembly 2100 is separated from the first connection pole piece 2410 and the second connection pole piece 2420, a magnetic flux passing through the holding face 2411 of the first connection pole piece 2410 and the holding face 2421 of the second connection pole piece 2420 is almost zero, and thus a workpiece can hardly be held on the holding faces 2411 and 2421.

Subsequently, when current applied to the first coil 2310 and the second coil 2320 in the direction indicated in FIG. 2B rises above a predetermine value, the first pole piece assembly 2100 is moved by magnetic force to be attached to the first connection pole piece 2410 and the second connection pole piece 2420, and accordingly the first pole piece assembly 2100 and the second pole piece assembly 2200 are in the first arrangement. When the first pole piece assembly 2100 is in the first arrangement as shown in FIG. 2C, a magnetic flux from the first permanent magnet 2130 passes through the workpiece 1, and thus the workpiece 1 can be held on the upper side as well.

Then, the magnetic fluxes already formed remain even if current is no more applied to the first coil 2310 and the second coil 2320, as indicated by the dashed lines in FIG. 2C. Accordingly, the workpiece 1 is held on the holding face 2411 of the first connection pole piece 2410 and the holding face 2421 of the second connection pole piece 2420, and the workpiece 2 is held on the holding faces 2211 and 2221 of the second pole piece assembly 2200.

In order to detach the workpieces 1 and 2 from the first pole piece assembly 2100 and the second pole piece assembly 2200, by applying current in the opposite direction to that of FIG. 2B to the first coil 2310 and the second coil 2320, the first pole piece assembly 2100 and the second pole piece assembly 2200 go back in the second arrangement as shown in FIG. 2A to thereby restore the magnetic flux shown in FIG. 2A.

The magnetic substance holding device 2000 according to this exemplary embodiment has an advantage in that it can hold workpieces 1 and 2 on both sides. In addition, at the time of detaching as shown in FIG. 2A, the first connection pole piece 2410/the second connection pole piece 2420 are separated from the first pole piece assembly 2100, and a magnetic flux flows inside the magnetic circuit in the first pole piece assembly 2100 and the second pole piece assembly 2200, leaving almost no residual magnetism.

Figure 3A:
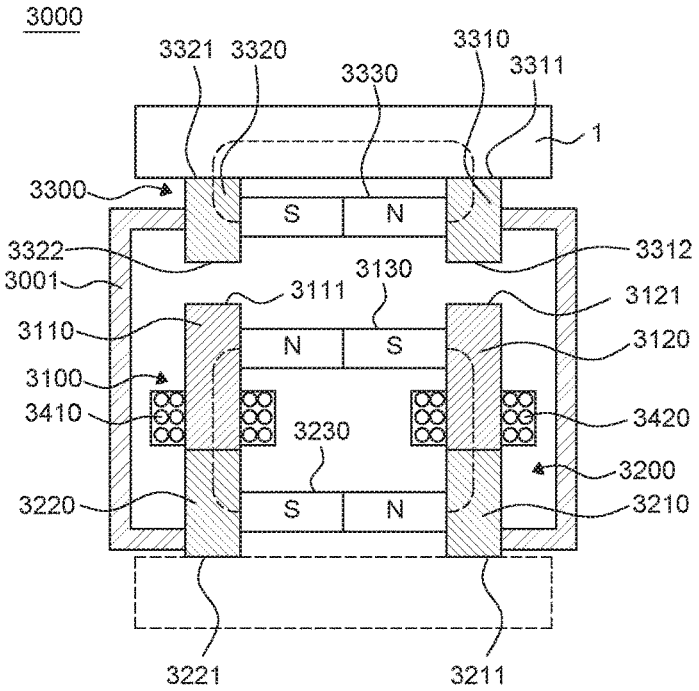
FIGS. 3A to 3C are schematic cross-sectional views of a magnetic substance holding device according to yet another exemplary embodiment of the present invention.
Figure 3B:
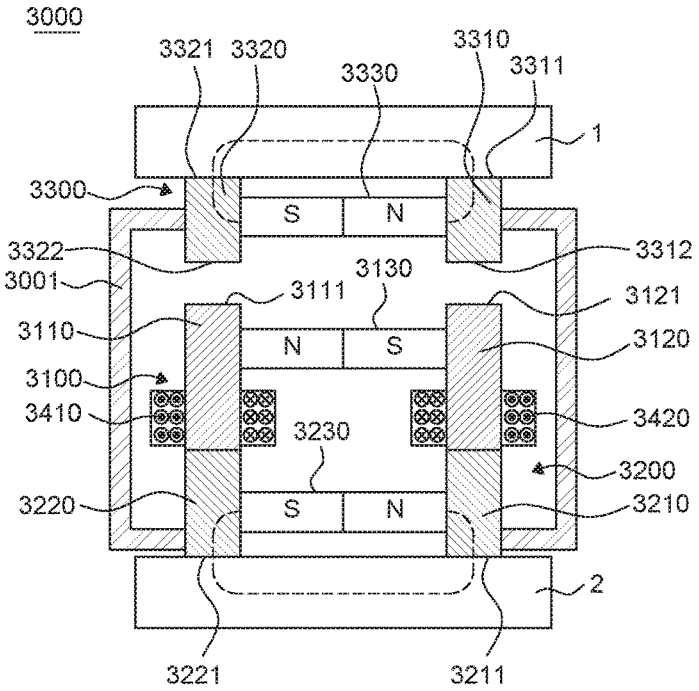
Figure 3C:
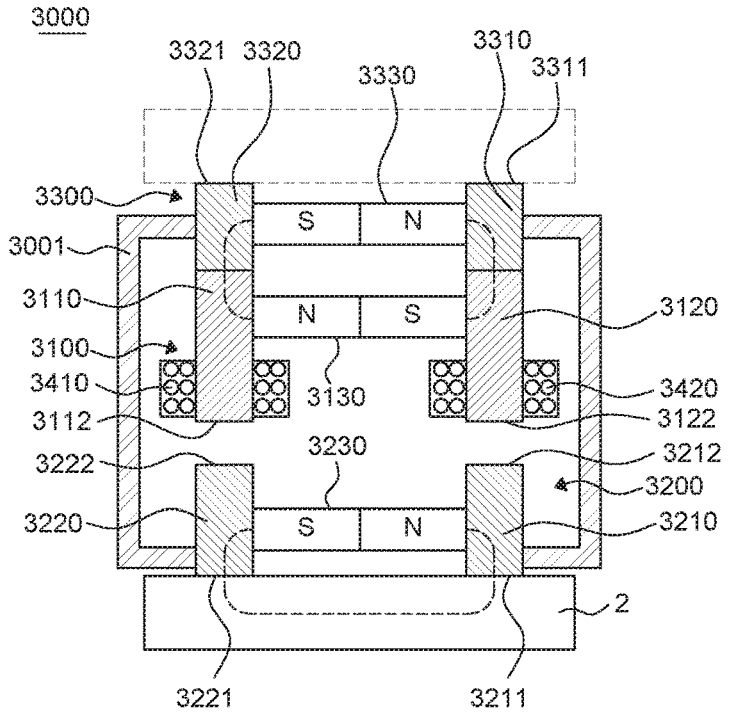

FIGS. 3A to 3C are schematic cross-sectional views of a magnetic substance holding device according to yet another exemplary embodiment of the present invention. Specifically, FIGS. 3A and 3C are schematic cross-sectional views of the magnetic substance holding device when it holds a workpiece, whereas FIG. 3B is a schematic cross-sectional view of the magnetic substance holding device in a transient state of changing a workpiece to be held.

Referring to FIGS. 3A to 3C, the magnetic substance holding device 3000 according to this exemplary embodiment includes a first pole piece assembly 3100, a second pole piece assembly 3200, a third pole piece assembly 3300, a first coil 3410, a second coil 3420, and a control device (not shown).

The first pole piece assembly 3100, the second pole piece assembly 3200, the first coil 3410 and the second coil 3420 are identical to the first pole piece assemblies 1100; 2100, the second pole piece assemblies 1200; 2200, the first coils 1310; 2310 and the second coils 1320; 2320 shown in FIGS. 1A to 1C; and FIGS. 2A to 2C, respectively. Therefore, redundant descriptions thereon will be omitted.

The third pole piece assembly 3300 includes a third N-pole piece 3310, a third S-pole piece 3320, and a third permanent magnet 3330. The third N-pole piece 3310 is a magnetic substance having a holding face 3311 and a contact face 3312. The third S-pole piece 3320 is a magnetic substance having a holding face 3321 and a contact face 3322. The N-pole of the third permanent magnet 3330 comes in contact with the third N-pole piece 3310 while the S-pole of the third permanent magnet 3330 comes in contact with the second S-pole piece 3320.

The first pole piece assembly 3100 and the third pole piece assembly 3300 are arranged so that the contact face 3322 of the third S-pole piece 3320 can come in contact with and be separated from the contact face 3111 of the first N-pole piece 3110 (i.e., they face each other) while the contact face 3312 of the third N-pole piece 3310 can come in contact with and be separated from the contact face 3121 of the first S-pole piece 3120 (i.e., they face each other).

The first pole piece assembly 3100 is movable in the vertical direction of FIGS. 3A to 3C, whereas the second pole piece assembly 3200 and the third pole piece assembly 3300 are stationary. Of course, however, the first pole piece assembly 3100 may be stationary whereas the second pole piece assembly 3200 and the third pole piece assembly 3300 may be movable.

For a first arrangement in which the first pole piece assembly 3100 is separated from the second pole piece assembly 3200 (the arrangement shown in FIG. 3C), the third pole piece assembly 3300 is arranged such that the holding faces 3111 and 3121 of the first pole piece assembly 3100 come in contact with the contact faces 3322 and 3312 of the third pole piece assembly 3300, respectively. For a second arrangement in which the first pole piece assembly 3100 comes in contact with the second pole piece assembly 3200 (the arrangement shown in FIGS. 3A and 3B), the third pole piece assembly 3330 is arranged such that the holding faces 3111 and 3121 of the first pole piece assembly 3100 are separated from the contact faces 3322 and 3312 of the third pole piece assembly 3300, respectively.

In this exemplary embodiment, the second pole piece assembly 3200 and the third pole piece assembly 3300 are stationary and may be covered by a cover 3001 which is a non-magnetic substance.

Referring to FIG. 3A, when the first pole piece assembly 3100 and the second pole piece assembly 3200 are in the second arrangement, with no current supply to the first coil 3310 and the second coil 3320, a magnetic flux flows inside the magnetic circuit in the first pole piece assembly 3100 and the second pole piece assembly 3200 and does not pass through the holding faces 3111, 3121, 3211 and 3221, and thus a workpiece cannot be held on the side of the second pole piece assembly 3200. On the contrary, a workpiece 1 can be held on the side of the third pole piece assembly 3300 by the magnetic force from the third permanent magnet 3330.

Then, when current in the direction indicated in FIG. 3B is applied to the first coil 3410 and the second coil 3420, the magnetic flux between the first pole piece assembly 3100 and the second pole piece assembly 3200 is disconnected, and a magnetic flux passing through the holding faces 3211 and 3221 of the second pole piece assembly 3200 becomes strong, so that a workpiece 2 can be attached on the side of the second pole piece assembly 3200. During this happens, the workpiece 1 keeps being held. Namely, both the workpiece 1 and the workpiece 2 can be held in a transient state.

Subsequently, when current applied to the first coil 3410 and the second coil 2320 in the direction indicated in FIG. 3B rises above a predetermine value, the first pole piece assembly 3100 is moved by magnetic force to be attached to the third pole piece assembly 3300, and accordingly the first pole piece assembly 3100 and the second pole piece assembly 3200 are in the first arrangement. When this happens, the magnetic flux formed by the third permanent magnet 3330, which was flowing through the workpiece 1, now flows inside the magnetic circuit in the first pole piece assembly 3100 and the third pole piece assembly 3300 by the magnetic force from the first permanent magnet. Accordingly, the workpiece 1 can be detached from the device whereas the workpiece 2 can be held by the device.

Then, the magnetic fluxes already formed remain even if current is no more applied to the first coil 3410 and the second coil 3420, as indicated by the dashed lines in FIG. 3C. Accordingly, the workpiece 2 is held on the holding faces 3211 and 3221 of the second pole piece assembly 3200.

In order to detach the workpiece 2 from the second pole piece assembly 3100 and to hold the workpiece 1 on the holding faces 3311 and 3321 of the third pole piece assembly 3300, by applying current in the opposite direction to that of FIG. 3B to the first coil 3410 and the second coil 3420, the first pole piece assembly 3100 and the second pole piece assembly 3200 go back in the second arrangement as shown in FIG. 3A to thereby restore the magnetic flux shown in FIG. 3A.

The magnetic substance holding device 3000 according to this exemplary embodiment has an advantage in that it can selectively hold the workpiece 1 or the workpiece 2. In addition, when the workpiece 1 is detached from the device, the magnetic flux flows inside the magnetic circuit in the first pole piece assembly 3100 and the third pole piece assembly 3300, and when the workpiece 2 is detached from the device, the magnetic flux flows inside the magnetic circuit in the first pole piece assembly 3100 and the second pole piece assembly 3200, leaving almost no residual magnetism.

Figure 4A:
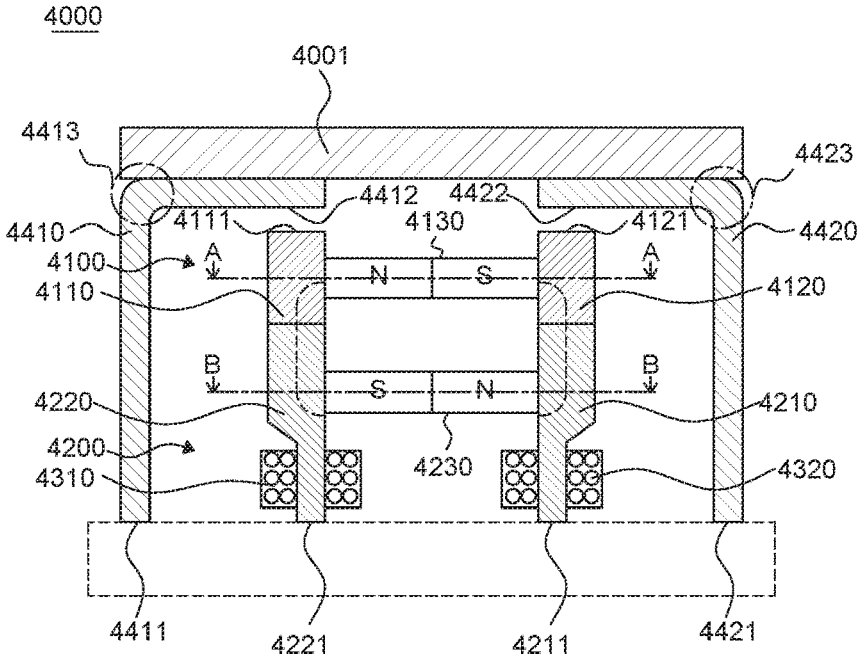
FIGS. 4A to 4C are schematic cross-sectional views of a magnetic substance holding device according to another exemplary embodiment of the present invention.
Figure 4B:
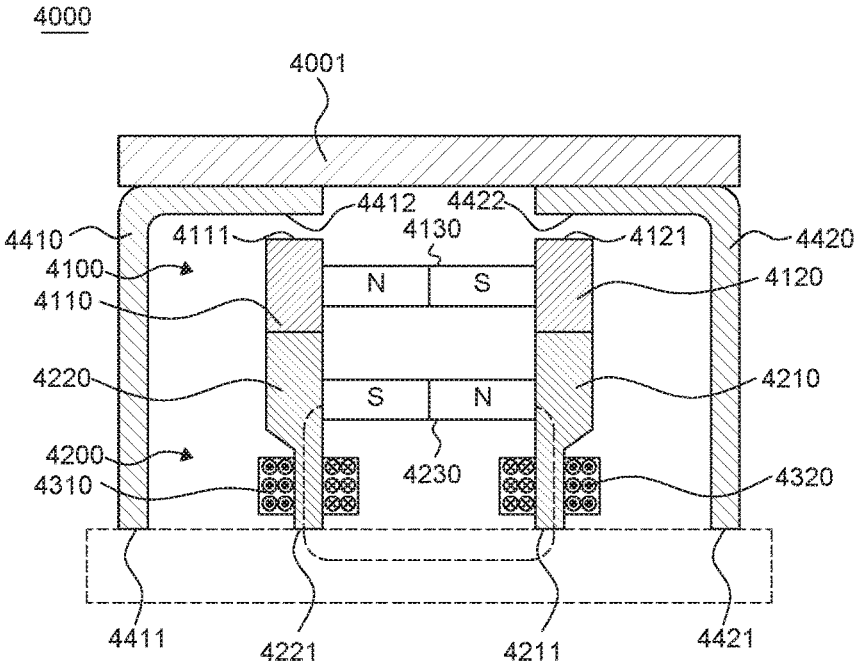
Figure 4C:
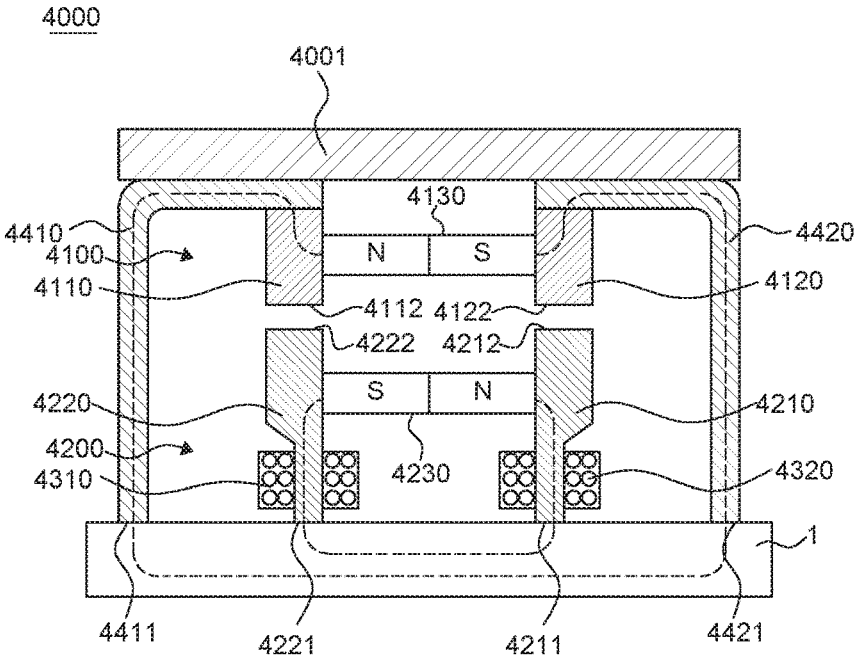
Figure 4D:
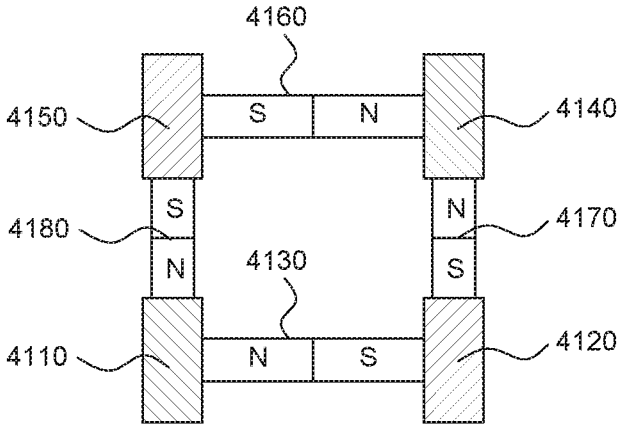
FIG. 4D is a cross-sectional view taken along line A-A of FIG. 4A.
Figure 4E:
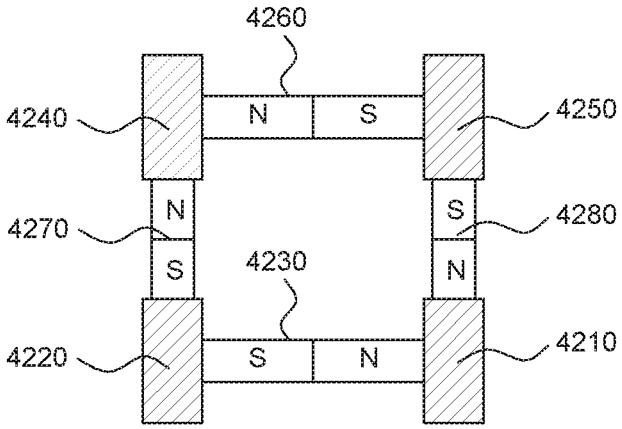
FIG. 4E is a cross-sectional view taken along line B-B of FIG. 4A.

FIGS. 4A to 4C are schematic cross-sectional views of a magnetic substance holding device according to yet another exemplary embodiment of the present invention. Specifically, FIG. 4A is a schematic cross-sectional view of the magnetic substance holding device when a workpiece is detached therefrom, whereas FIGS. 4B and 4C are schematic cross-sectional views of the magnetic substance holding device when it holds a workpiece. FIG. 4D is a cross-sectional view taken along line A-A of FIG. 4A, and FIG. 4E is a cross-sectional view taken along line B-B of FIG. 4A.

Referring to FIGS. 4A to 4C, the magnetic substance holding device 4000 according to this exemplary embodiment includes a first pole piece assembly 4100, a second pole piece assembly 4200, a first coil 4310, a second coil 4320, a first connection pole piece 4410, a second connection pole piece 4420, and a control device (not shown).

The first pole piece assembly 4100, the second pole piece assembly 4200, the first coil 4310 and the second coil 4320 are identical to the first pole piece assembly 2100, the second pole piece assembly 2200, the first coil 2310 and the second coil 2320 shown in FIGS. 2A to 2C; and, therefore, redundant descriptions thereon will be omitted. The feature of this exemplary embodiment lies in the locations of the holding faces of the first connection pole piece 4410 and the second connection pole piece 4420, which are different from the locations of the holding faces of the first connection pole piece 2410 and the second connection pole piece 2420 shown in FIGS. 2A to 2C.

A holding face 4411 of the first connection pole piece 4310 and a holding face 4421 of the second connection pole piece 4420 are adapted to hold a workpiece 1 thereon. To this end, the first connection pole piece 4410 and the second connection pole piece 4420 surround the first pole piece assembly 4100 and the second pole piece assembly 4200. In this exemplary embodiment, the holding face 4411 of the first connection pole piece 4410, the holding face 4421 of the second connection pole piece 4420, the holding faces 4211 and 4221 of the second pole piece assembly 4200 are adapted to have a plane shape. However, they may form different shapes depending on the shape of the workpiece 1.

In other words, the holding face 4411 of the first connection pole piece 4410, the holding face 4421 of the second connection pole piece 4420, and the holding faces 4211 and 4221 of the second pole piece assembly 4200 are adapted to attach a single workpiece thereto.

In addition, a cover 4001 which is a non-magnetic substance may be provided to connect the first connection pole piece 4410 and the second connection pole piece 4420 to each other and fix them.

Further, the magnetic substance holding device 4000 according to this exemplary embodiment further includes means for reducing residual magnetism, in addition to the elements included in the magnetic substance holding device 2000. The means for reducing residual magnetism will be described in detail below.

When the first pole piece assembly 4100 and the second pole piece assembly 4200 are in the second arrangement as shown in FIG. 4A, residual magnetism is created in a such manner that a part of the magnetic flux flowing in the magnetic circuit (indicated by the dashed line) comes out of the circuit to affect the workpiece 1. Therefore, in order to eliminate residual magnetism, it is necessary to enhance the magnetic circuit while making it difficult for magnetic fluxes to come out of the circuit.

Referring to FIGS. 4A to 4C, it is desirable that the area of the holding face 4211 of the second N-pole piece 4210 is smaller than the average cross-sectional area where the second permanent magnet 4230 comes in contact with the second N-pole piece 4210, and the area of the holding face 4221 of the second S-pole piece 4220 is smaller than the average cross-sectional area where the second permanent magnet 4230 comes in contact with the second S-pole piece 4220. In other words, residual magnetism can be reduced by way of making thicker the areas where the first N-pole piece 4110 and the first S-pole pieces 4120 come in contact with the first permanent magnet 4130, the areas where the second N-pole piece 4210 and the second S-pole piece 4220 come in contact with the second permanent magnet 4230 and the areas therebetween, while making thinner other areas. Namely, it is possible to eliminate residual magnetism by way of making it difficult to form magnetic fluxes toward the holding faces 4211 and 4221.

On the other hand, it is desirable to shape inner sides of the second N-pole piece 4210 and the second S-pole piece to be linear, to facilitate a magnetic flux between the second permanent magnet 4230 and the workpiece 1 so that attaching force can be enhanced.

In addition, it is beneficial to dispose the first coil 4310 between the second permanent magnet 4230 and the holding face 4221 of the second pole piece assembly 4200 and dispose the second coil 4230 between the second permanent magnet 4230 and the holding face 4211 thereof. In addition, it is also possible to dispose the first coil 4310 between the first permanent magnet 4130 and the holding face 4111 of the first pole piece assembly 4100 and dispose the second coil 4320 between the first permanent magnet 4130 and the holding face 4121 thereof. Such disposal of the coils 4310 and 4320 may be applied to other exemplary embodiments.

Further, in order to enhance attracting force, it is necessary to facilitate a magnetic flux generated form the first permanent magnet 4130 or the second permanent magnet 4230. Referring to FIGS. 4A to 4C, it is desirable for the first connection pole piece 4410 and the second connection pole piece 4420 to have chamfered or filleted corners so that the shortest path (indicated by the dashed line in FIG. 4C) among magnetic flux paths is not bent at a right angle. Namely, as shown in FIGS. 4A to 4C, it is desirable to make filleted corners 4413 and 4423 in order to facilitate magnetic fluxes, because otherwise magnetic eddy current occurs at right-angle corners to thereby weaken the intensity of magnetic fluxes. It is to be understood that such features can be applied to other exemplary embodiments. Namely, such features can be applied to N-pole pieces and S-pole pieces, as well as the first connection pole pieces 4410 and the second connection pole piece 4420.

Other operating principles are identical to those described above with respect to the exemplary embodiment shown in FIGS. 2A to 2C; and, therefore, descriptions thereon will not be made.

Although the first pole piece assembly 4100 may be a pair of pole pieces 4110 and 4120, it may further include behind them a first auxiliary N-pole piece 4140, a first auxiliary S-pole piece 4150, a first reinforcement permanent magnet 4160, a second reinforcement permanent magnet 4170, and a third reinforcement permanent magnet 4180, as shown in FIG. 4D.

The first reinforcement permanent magnet 4160 has an N-pole to be in contact with the first auxiliary N-pole piece 4140 and an S-pole to be in contact with the first auxiliary S-pole piece 4150. The second reinforcement permanent magnet 4170 has an N-pole to be in contact with the first auxiliary N-pole piece 4140 and an S-pole to be in contact with the first S-pole piece 4120. The third reinforcement permanent magnet 4180 has an S-pole to be in contact with the first auxiliary S-pole piece 4150 and an N-pole to be in contact with the first N-pole piece 4110.

Likewise, although the second pole piece assembly 4200 may be a pair of pole pieces 4210 and 4220, it may further include behind them a second auxiliary N-pole piece 4240, a second auxiliary S-pole piece 4250, a fourth reinforcement permanent magnet 4260, a fifth reinforcement permanent magnet 4270, and a sixth reinforcement permanent magnet 4280, as shown in FIG. 4E.

The fourth reinforcement permanent magnet 4260 has an N-pole to be in contact with the second auxiliary N-pole piece 4240 and an S-pole to be in contact with the second auxiliary S-pole piece 4250. The fifth reinforcement permanent magnet 4270 has an N-pole to be in contact with the first auxiliary N-pole piece 4240 and an S-pole to be in contact with the second S-pole piece 4220. The sixth reinforcement permanent magnet 4280 has an S-pole to be in contact with the second auxiliary S-pole piece 4250 and an N-pole to be in contact with the second N-pole piece 4210.

The first auxiliary N-pole piece 4140 and the first auxiliary S-pole piece 4150 may be configured to be in contact with and separated from additional connection pole pieces, respectively, which are separated from the first connection pole pieces 4410 and the second connection pole piece 4420. According to the exemplary embodiment with the configurations shown in FIGS. 4D and 4E, there are four sets of N-/S-pole piece-connection pole piece, each set separated from one another and connected by a permanent magnet to one another.

By employing the configurations shown in FIGS. 4D and 4E, more permanent magnets can be provided per unit volume, so that holding force can be increased. Additionally, magnetic circuits in the horizontal direction are created, so that residual magnetism can be further reduced.

Figure 5A:
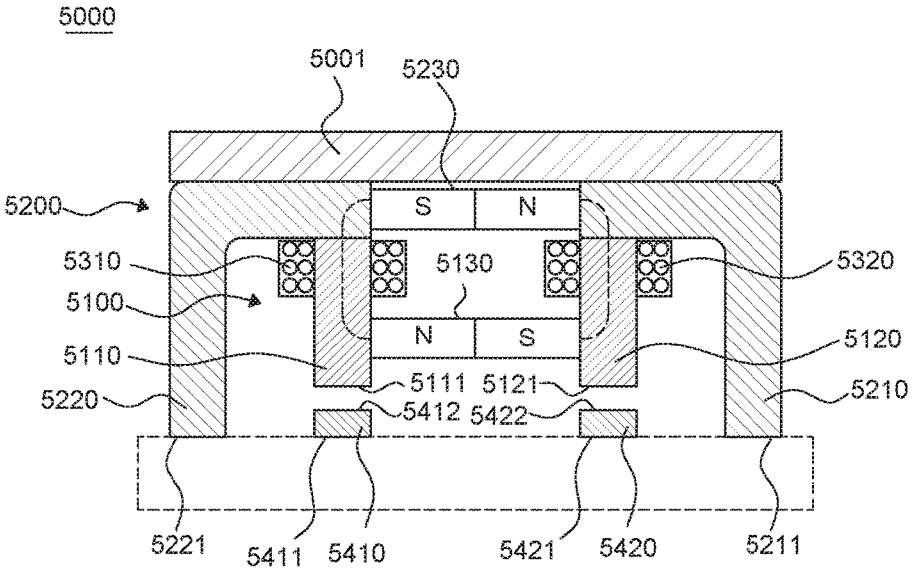
FIGS. 5A to 5C are schematic cross-sectional views of a magnetic substance holding device according to yet another exemplary embodiment of the present invention.
Figure 5B:
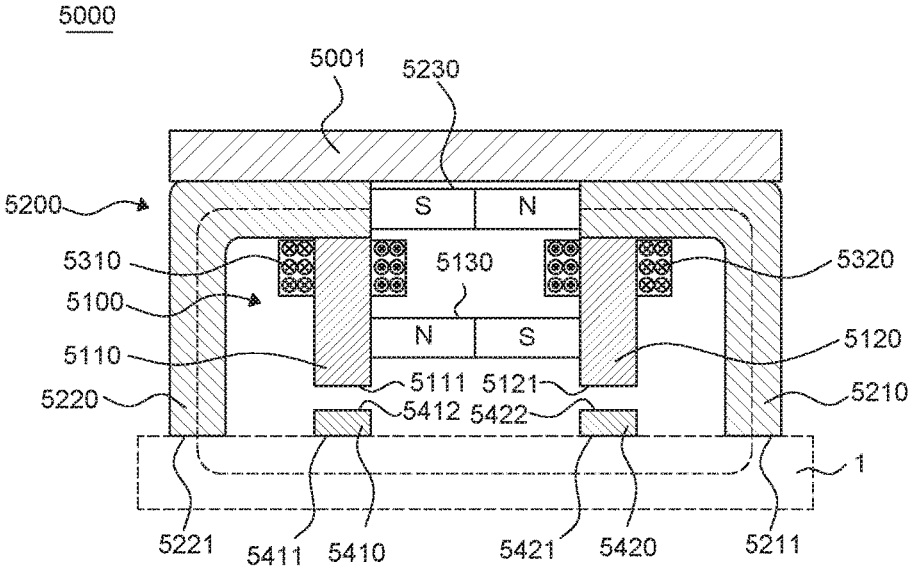
Figure 5C:
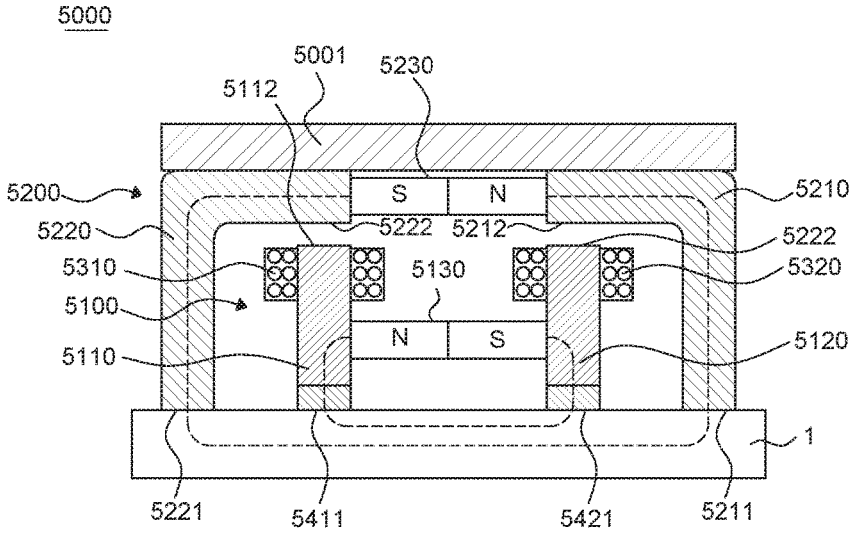

FIGS. 5A to 5C are schematic cross-sectional views of a magnetic substance holding device according to yet another exemplary embodiment of the present invention. Specifically, FIG. 5A is a schematic cross-sectional view of the magnetic substance holding device when a workpiece is detached therefrom, whereas FIGS. 5B and 5C are schematic cross-sectional views of the magnetic substance holding device when it holds a workpiece.

Referring to FIGS. 4A to 4C, the magnetic substance holding device 5000 according to this exemplary embodiment includes a first pole piece assembly 5100, a second pole piece assembly 5200, a first coil 5310, a second coil 5320, a first connection pole piece 5410, a second connection pole piece 5420, and a control device (not shown).

Descriptions will be made focusing on differences between the magnetic substance holding device according to this exemplary embodiment and the magnetic substance holding devices 1000 to 4000, and redundant descriptions will be omitted.

The first pole piece assembly 5100 is movable whereas the second pole piece assembly 5200 is stationary. In particular, the holding faces 5211 and 5221 of the second pole piece assembly 5200, the holding face 5411 of the first connection pole piece 5410, and the holding face 5421 of the second connection pole piece 5420 are adapted to hold a single workpiece 1, which is a magnetic substance. In other words, according to this exemplary embodiment, the second N-pole piece 5210 and the second S-pole piece 5220 of the second pole piece assembly 5200 are adapted to do this end.

The first connection pole piece 5410 has a holding face 5411 and a contact face 5412 and is a magnetic substance. The second connection pole piece 5420 has a holding face 5421 and a contact face 5422 and is a magnetic substance.

For a first arrangement in which the first pole piece assembly 5100 is separated from the second pole piece assembly 5200 (the arrangement shown in FIG. 2C), the first connection pole piece 5410 and the second connection pole piece 5412 are arranged such that the holding faces 5111 and 5121 of the first pole piece assembly 5100 come in contact with the contact face 5412 of the first connection pole piece 5410 and the contact face 5422 of the second connection pole piece 5420, respectively. For a second arrangement in which the first pole piece assembly 5100 comes in contact with the second pole piece assembly 5200 (the arrangement shown in FIGS. 2A and 2B), the first connection pole piece 5410 and the second connection pole piece 5420 are arranged such that the holding faces 5111 and 5121 of the first pole piece assembly 5100 are separated from the contact face 5412 of the first connection pole piece 5410 and the contact face 5422 of the second connection pole piece 5420, respectively.

In this exemplary embodiment, the first connection pole piece 5410, the second connection pole piece 5420, and the second pole piece assembly 5200 are stationary and may be covered by a cover 5001 which is a non-magnetic substance.

The first coil 5310 is wound around the first N-pole piece 5110, and the second coil 5320 is wound around the first S-pole piece. However, the present invention is not limited thereto, but the first coil 5310 and the second coil 5320 may be wound around the first connection pole pieces 5410 and the second connection pole piece 5420, respectively. Other modifications are also possible.

Other operating principles are identical to those described above; and, therefore, descriptions thereon will not be made.

Figure 6A:
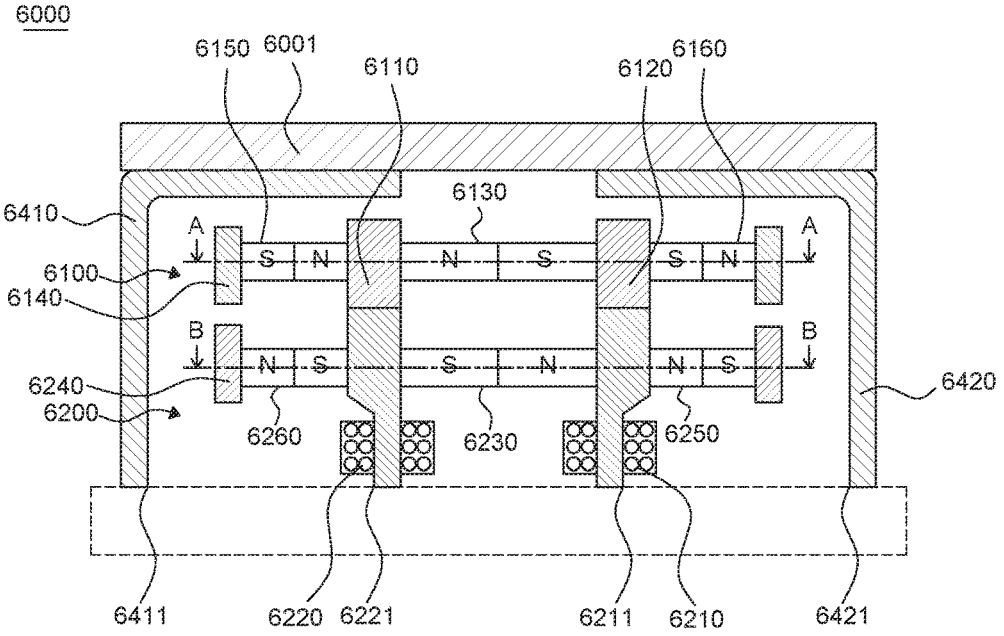
FIG. 6A is a schematic cross-sectional view of a magnetic substance holding device according to yet another exemplary embodiment of the present invention.
Figure 6B:
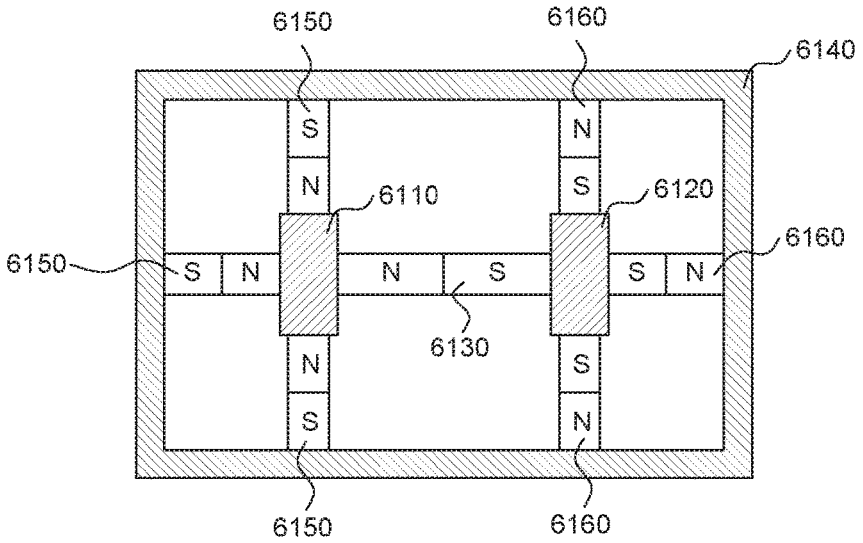
FIG. 6B is a cross-sectional view taken along line A-A of FIG. 6A.
Figure 6C:
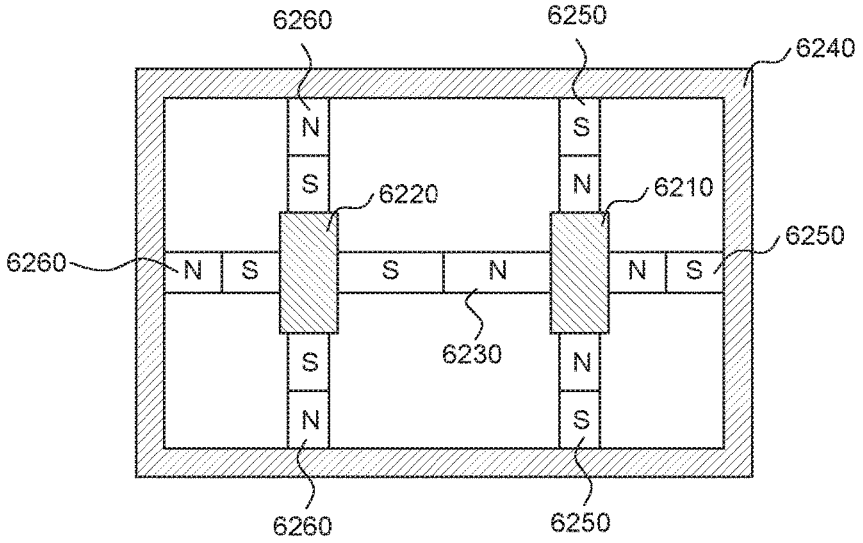
FIG. 6C is a cross-sectional view taken along line B-B of FIG. 6A.

FIG. 6A is a schematic cross-sectional view of a magnetic substance holding device according to another exemplary embodiment of the present invention, FIG. 6B is a cross-sectional view taken along line A-A of FIG. 6A, and FIG. 6C is a cross-sectional view taken along line B-B of FIG. 6A.

Referring to FIG. 6A, the magnetic substance holding device 6000 according to this exemplary embodiment includes the configuration of the magnetic substance holding device 4000 shown in FIGS. 4A to 4C and further enhances holding force.

Referring to FIG. 6B, the first pole piece assembly 6100 further includes a first reinforcement pole piece 6140, at least one first reinforcement permanent magnet 6150, and at least one second reinforcement permanent magnet 6160, in addition to the basic elements.

The first reinforcement pole piece 6140 is a magnetic substance and surrounds the first N-pole piece 6110 and the first S-pole piece 6120. The S-pole of the first reinforcement permanent magnet 6150 comes in contact with the first reinforcement pole piece 6140 while the N-pole thereof comes in contact with the first N-pole piece 6110. The N-pole of the second reinforcement permanent magnet 6160 comes in contact with the first reinforcement pole piece 6140 while the S-pole thereof comes in contact with the first S-pole piece 6120.

Referring to FIG. 6C, the second pole piece assembly 6200 further includes a second reinforcement pole piece 6240, at least one third reinforcement permanent magnet 6250, and at least one fourth reinforcement permanent magnet 6260, in addition to the basic elements.

The second reinforcement pole piece 6240 is a magnetic substance and surrounds the second N-pole piece 6210 and the second S-pole piece 6220. The S-pole of the third reinforcement permanent magnet 6250 comes in contact with the first reinforcement pole piece 6240 while the N-pole thereof comes in contact with the second N-pole piece 6210. The N-pole of the fourth reinforcement permanent magnet 6260 comes in contact with the first reinforcement pole piece 6240 while the S-pole thereof comes in contact with the second S-pole piece 6220.

By employing the configurations shown in FIGS. 6A to 6C, more permanent magnets can be provided per unit volume, so that holding force can be increased. Additionally, magnetic circuits in the horizontal direction are created, so that residual magnetism can be further reduced.

Figure 7:
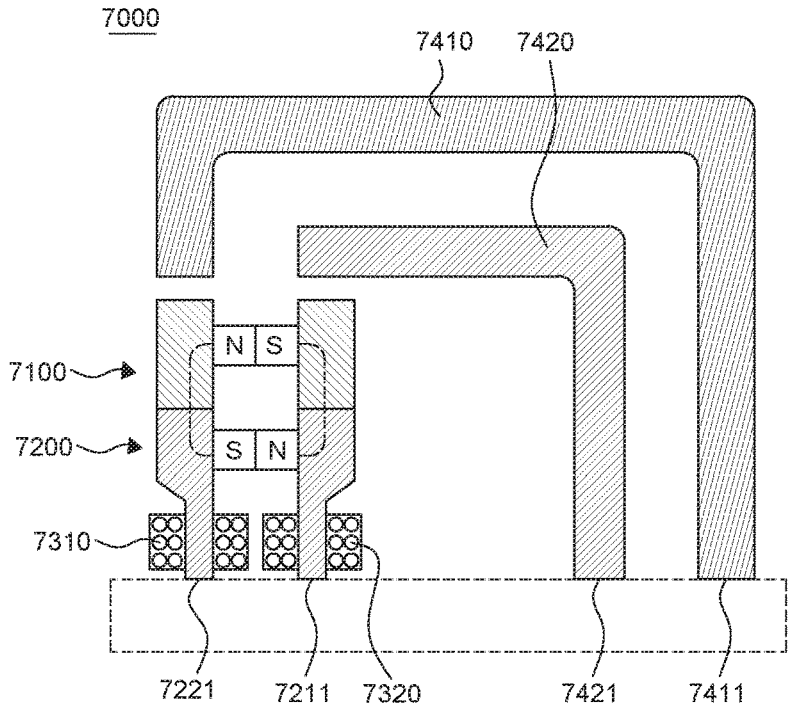
FIG. 7 is a schematic cross-sectional view of a magnetic substance holding device according to yet another exemplary embodiment of the present invention.

FIG. 7 is a schematic cross-sectional view of a magnetic substance holding device according to yet another exemplary embodiment of the present invention.

Referring to FIG. 7, the magnetic substance holding device 7000 according to this exemplary embodiment includes a first pole piece assembly 7100, a second pole piece assembly 7200, a first coil 7310, a second coil 7320, a first connection pole piece 7410, a second connection pole piece 7420, and a control device (not shown).

The magnetic substance holding device 7000 shown in FIG. 7 has a configuration similar to that of the magnetic substance holding device 4000 shown in FIGS. 4A to 4C, with a modification to the first connection pole piece 7410. According to this exemplary embodiment, the holding face 7411 of the first connection pole piece 7410 and the holding face 7421 of the second connection pole piece 7420 are adjacent to each other. The holding faces 7211 and 7221 of the second pole piece assembly 7200 are adjacent to each other. Magnetic fluxes primarily flow between the adjacent holding faces through a workpiece, whereas a magnetic flux rarely flows between holding faces which are not adjacent to each other. Accordingly, it is possible to prevent magnetic fluxes from crossing each other, so that holding force can be further increased. In order to further increase holding force, a distance between the holding face 7211 and the holding face 7421 can be further increased.

Other elements are identical to those described with respect to FIGS. 4A to 4C; and, therefore, descriptions thereon will not be made.

Figure 8:
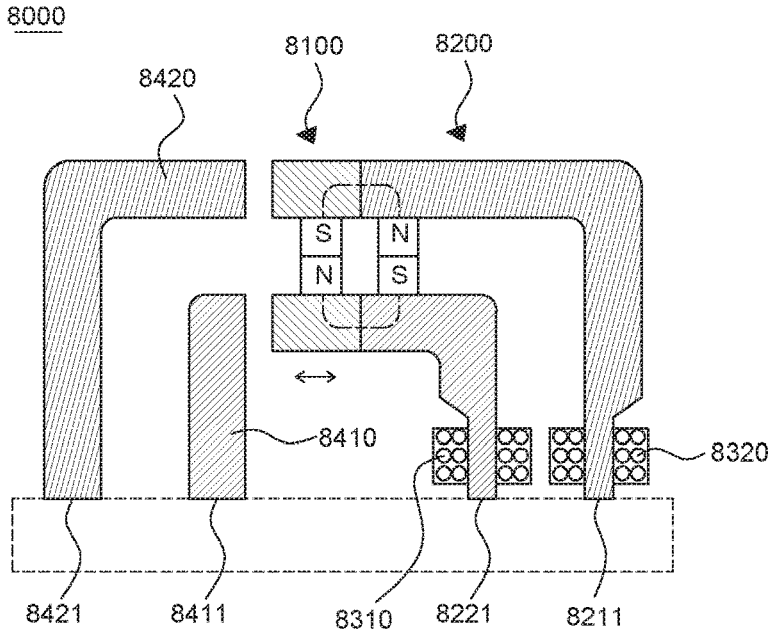
FIG. 8 is a schematic cross-sectional view of a magnetic substance holding device according to yet another exemplary embodiment of the present invention.

FIG. 8 is a schematic cross-sectional view of a magnetic substance holding device according to yet another exemplary embodiment of the present invention.

Referring to FIG. 8, the magnetic substance holding device 8000 according to this exemplary embodiment includes a first pole piece assembly 8100, a second pole piece assembly 8200, a first coil 8310, a second coil 8320, a first connection pole piece 8410, a second connection pole piece 8420, and a control device (not shown).

The magnetic substance holding device 8000 shown in FIG. 8 has a configuration similar to that of the magnetic substance holding device 7000 shown in FIG. 7, with a change to the moving direction of the first pole piece assembly 8100. Referring to FIG. 8, the first pole piece assembly 8100 is movable along a plane extended from the holding faces 8211 and 8221 of the second pole piece assembly 8200, the holding faces 8411 and 8421 of the first connection pole piece 8410 and the second connection pole piece 8420. In other words, the first pole piece assembly 8100 is movable in the horizontal direction.

Other elements are identical to those described with respect to FIGS. 4A to 4C and FIG. 7; and, therefore, descriptions thereon will not be made.

Figure 9A:
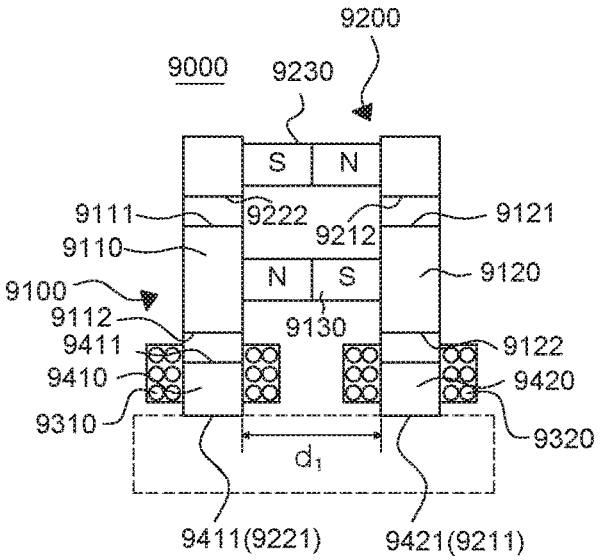
FIGS. 9A and 9B are a schematic front view and a schematic side view of a magnetic substance holding device according to yet another exemplary embodiment of the present invention, respectively.
Figure 9B:
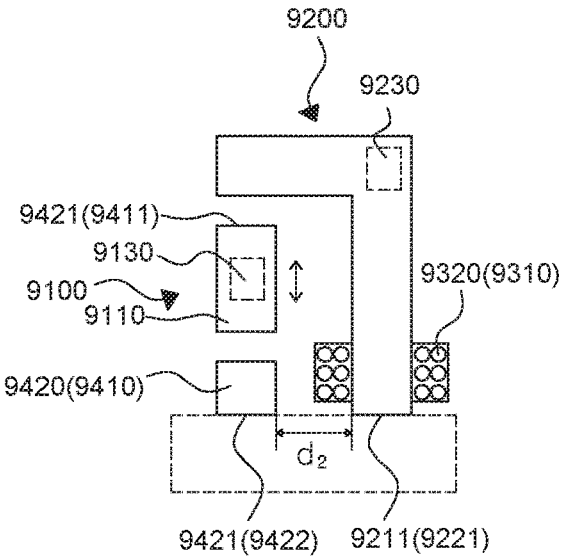

FIGS. 9A and 9B are a front view and a side view of a magnetic substance holding device according to yet another exemplary embodiment of the present invention, respectively.

Referring to FIG. 9, the magnetic substance holding device 9000 according to this exemplary embodiment includes a first pole piece assembly 9100, a second pole piece assembly 9200, a first coil 9310, a second coil 9320, a first connection pole piece 9410, a second connection pole piece 9420, and a control device (not shown).

The magnetic substance holding device 9000 shown in FIG. 9 has a configuration similar to that of the magnetic substance holding device 5000 shown in FIGS. 5A to 5C, with a modification to the second pole piece assembly 9200.

The first pole piece assembly 9100 is movable in the vertical direction. The holding faces 9211 and 9221 of the second pole piece assembly 9200 are arranged behind the holding face 9411 of the first connection pole piece 9410 and the holding face 9421 of the second connection pole piece 9420. Accordingly, when seen from the bottom, the holding faces 9211 and 9221 of the second pole piece assembly 9200, the holding face 9411 of the first connection pole piece 9410 and the holding face 9421 of the second connection pole piece 9420 are arranged in a quadrangular shape.

In order to prevent magnetic fluxes from crossing each other, it is desirable to reduce a distance $d_1$ between the N-pole pieces 9110 and 9210 and the S-pole pieces 9120 and 9220 and increase a distance $d_2$ between the holding faces 9211 and 9221 of the second pole piece assembly 9200 and the holding faces 9411 and 9421 of the first and second connection pole pieces.

Other elements are identical to those described with respect to FIGS. 5A to 5C; and, therefore, descriptions thereon will not be made.

Figure 10A:
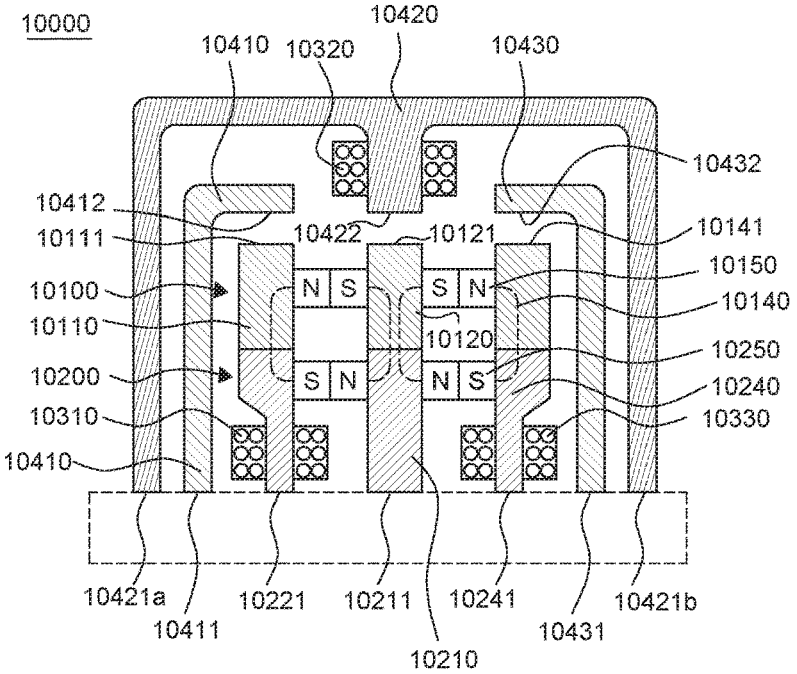
FIGS. 10A to 10C are schematic cross-sectional views of a magnetic substance holding device according to another exemplary embodiment of the present invention.
Figure 10B:
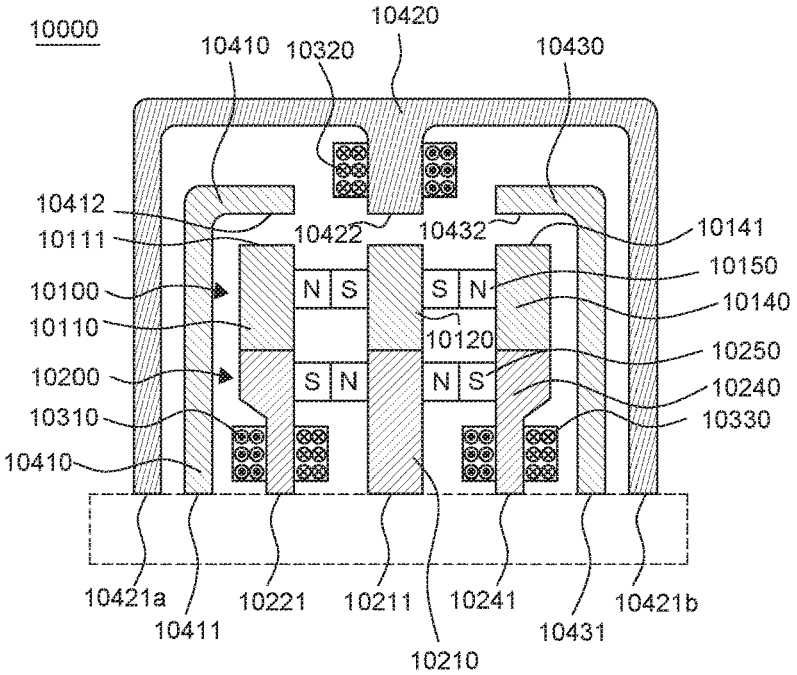
Figure 10C:
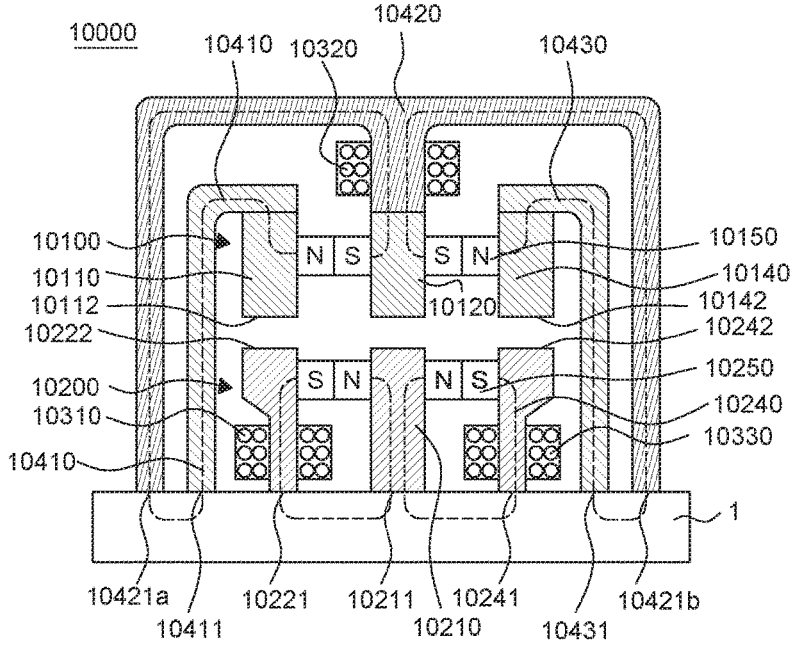

FIGS. 10A to 10C are cross-sectional views of a magnetic substance holding device according to yet another exemplary embodiment of the present invention.

Referring to FIGS. 10A to 10C, the magnetic substance holding device 10000 according to this exemplary embodiment includes a first pole piece assembly 10100, a second pole piece assembly 10200, a first coil 10310, a second coil 10320, a third coil 10300, a first connection pole piece 10410, a second connection pole piece 10420, a third connection pole piece 10430, and a control device (not shown).

The magnetic substance holding device 10000 shown in FIGS. 10A to 10C is an expansion of the magnetic substance holding device 4000 shown in FIGS. 4A to 4C.

In addition to the elements included in the magnetic substance holding device 4000, the magnetic substance holding device 10000 according to this exemplary embodiment further includes the third coil 10330 and the third connection pole piece 10430. Further, the first pole piece assembly 10100 and the second pole piece assembly 10200 have additional elements, with a modification to the second connection pole piece 10420.

The third connection pole piece 10430 has a holding face 10431 and a contact face 10432. The third connection pole piece 10430 and the first connection pole piece 10410 may be symmetric with each other.

The second connection pole piece 10420 has at least two holding faces 10421*a* and 10421*b*. The holding faces 10421*a* and 10421*b* are located on outer sides so that the second connection pole piece 10420 surrounds the first pole piece assembly 10100 and the second pole piece assembly 10200.

The first pole piece assembly 10100 further includes a third N-pole piece 10140 having a holding face 10141 and a contact face 10142 and being a magnetic substance, and a third permanent magnet 10150. The S-pole of the third permanent magnet 10150 comes in contact with the first S-pole piece 10120 and the N-pole thereof comes in contact with the third N-pole piece 10140.

The second pole piece assembly 10200 further includes a third S-pole piece 10240 having a holding face 10241 and a contact face 10242 and being a magnetic substance, and a fourth permanent magnet 10250. The N-pole of the fourth permanent magnet 10250 comes in contact with the second N-pole piece 10210 and the S-pole thereof comes in contact with the third S-pole piece 10240.

The third coil 10330 is disposed so that it affects at least one of a magnetic flux passing through the holding face 10140 of the third N-pole piece 10140 and a magnetic flux passing through the holding face 10241 of the third S-pole piece 10240. In this exemplary embodiment, the third coil 10330 is disposed between the fourth permanent magnet 10250 and the holding face 10241.

For a first arrangement in which the first pole piece assembly 10100 is separated from the second pole piece assembly 10200 (the arrangement shown in FIG. 10C), the first connection pole piece 10410, the second connection pole piece 10420 and the third connection pole piece 10430 are arranged such that the holding faces 10111, 10121 and 10141 of the first pole piece assembly 10100 come in contact with the contact faces 10412, 10422 and 10432 of the first connection pole piece 10410, the second connection pole piece 10420 and the third connection pole piece 10430, respectively. For a second arrangement in which the first pole piece assembly 10100 comes in contact with the second pole piece assembly 10200 (the arrangement shown in FIG. 10A), the first connection pole piece 10410, the second connection pole piece 10420 and the third connection pole piece 10430 are arranged such that the holding faces 10111, 10121 and 10141 of the first pole piece assembly 10100 are separated from the contact faces 10412, 10422 and 10432 of the first connection pole piece 10410, the second connection pole piece 10420 and the third connection pole piece 10430, respectively.

The holding faces 10211, 10221 and 10241 of the second pole piece assembly 10200, the holding face 10411 of the first connection pole piece 10410, the holding faces 10421*a* and 10421*b* of the second connection pole piece 10420 and the holding face 10431 of the third connection pole piece 10430 are adapted to hold a single workpiece 1, which is a magnetic substance.

When the first pole piece assembly 10100 and the second pole piece assembly 10200 are in the first arrangement as show in FIG. 10C, a workpiece 1 is held on the holding faces 10211, 10221 and 10241 of the second pole piece assembly 10200, the holding face 10411 of the first connection pole piece 10410, the holding faces 10421*a* and 10421*b* of the second connection pole piece 10420, and the holding face 10431 of the third connection pole piece 10430. When the first pole piece assembly 10100 and the second pole piece assembly 10200 are in the second arrangement as show in FIG. 10A, the workpiece 1 is detached from the holding faces 10211, 10221 and 10241 of the second pole piece assembly 10200, the holding face 10411 of the first connection pole piece 10410, the holding faces 10421*a* and 10421*b* of the second connection pole piece 10420, and the holding face 10431 of the third connection pole piece 10430.

The holding face 10421*a* of the second connection pole piece 10420 is adjacent to the holding face 10411 of the first connection pole piece 10401, and the holding face 10421*b* of the second connection pole piece is adjacent to the holding face 10431 of the third connection pole piece 10430.

The control device adjusts current applied to the first coil 10310, the second coil 10320 and the third coil 10330 so as to control the magnetic fluxes passing through the first coil 10310, the second coil 10320 and the third coil 10330. By doing so, the first pole piece assembly 10100 and the second pole piece assembly 10200 can be switched between the first arrangement and the second arrangement, and the magnetic fluxes passing through the holding face of the first pole piece assembly 10100, the holding face of the second pole piece assembly 10200, the holding face of the first connection pole piece 10410, the holding faces of the second connection pole piece 10420, and the holding face of the third connection pole piece 10430 can be controlled.

Specifically, when current is applied to the first coil 10310, the second coil 10320 and the third coil 10330 in the direction indicated in FIG. 10B, the magnetic fluxes indicated in FIG. 10A are disconnected whereas the magnetic fluxes passing through the holding faces 10211, 10221 and 10241 of the second pole piece assembly 10200 become strong. On the other hand, magnetic fluxes passing through the contact faces 10212, 10222 and 10242 become weak. Consequently, the first pole piece assembly 10100 moves upwardly, so that the magnetic fluxes shown in FIG. 10C are formed, and accordingly the workpiece 1 is held by the device.

Incidentally, the contact face 10422 of the second connection pole piece 10420 is formed at an end of a projection 10423. The second coil 10320 is wound around the projection 10423. Namely, the second coil 10320 may be disposed outside the first pole piece assembly 10100.

Other elements are identical to those described with respect to FIGS. 4A to 4C; and, therefore, descriptions thereon will not be made.

Figure 11A:
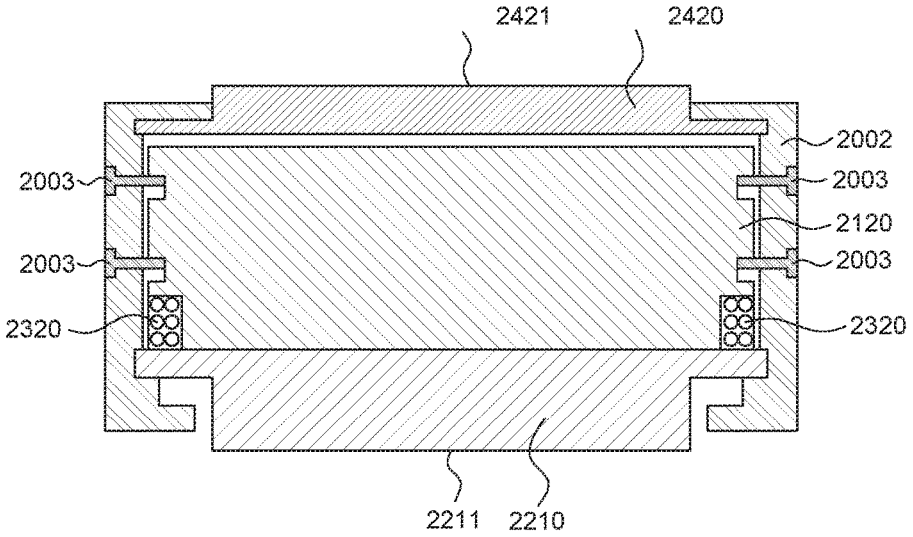
FIGS. 11A and 11B are side cross-sectional views of the magnetic substance holding device of FIGS. 2A to 2C.
Figure 11B:
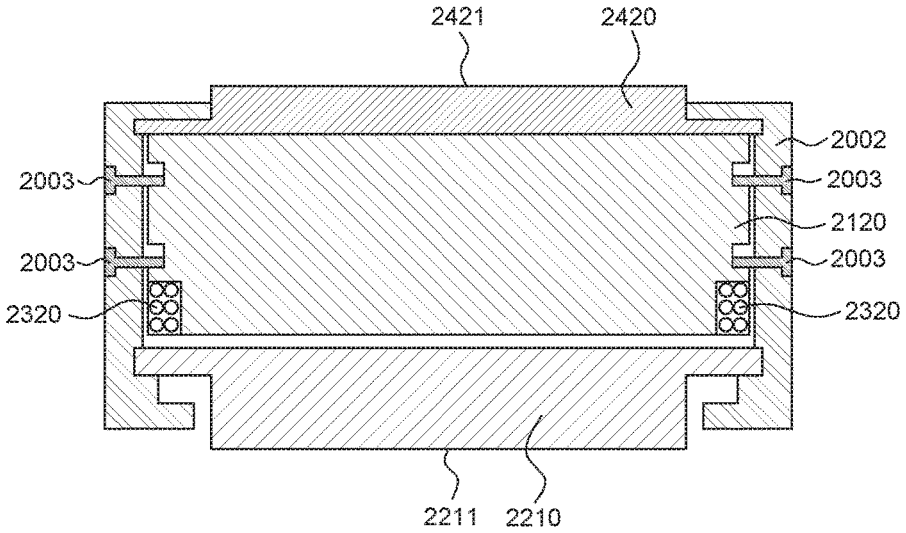
Figure 12A:
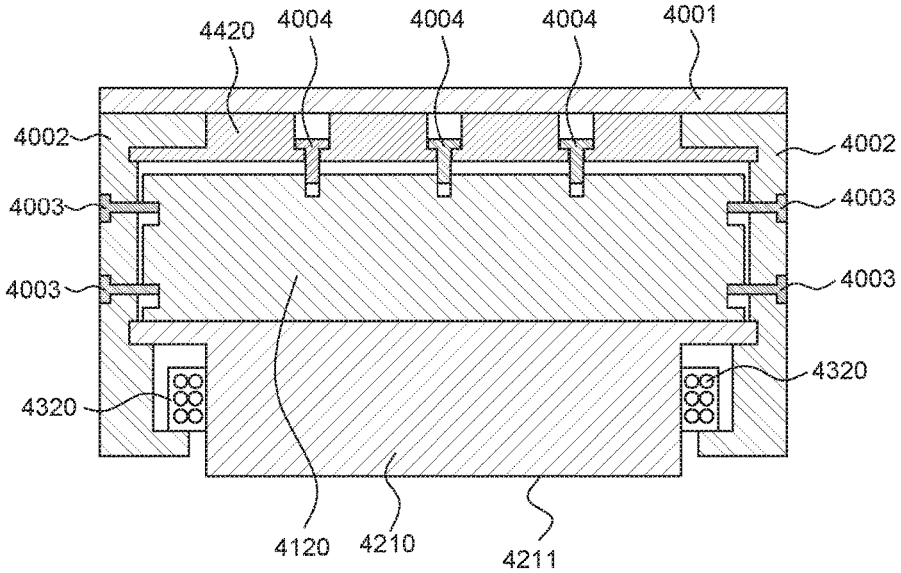
FIGS. 12A and 12B are side cross-sectional views of the magnetic substance holding device of FIGS. 4A to 4C.
Figure 12B:
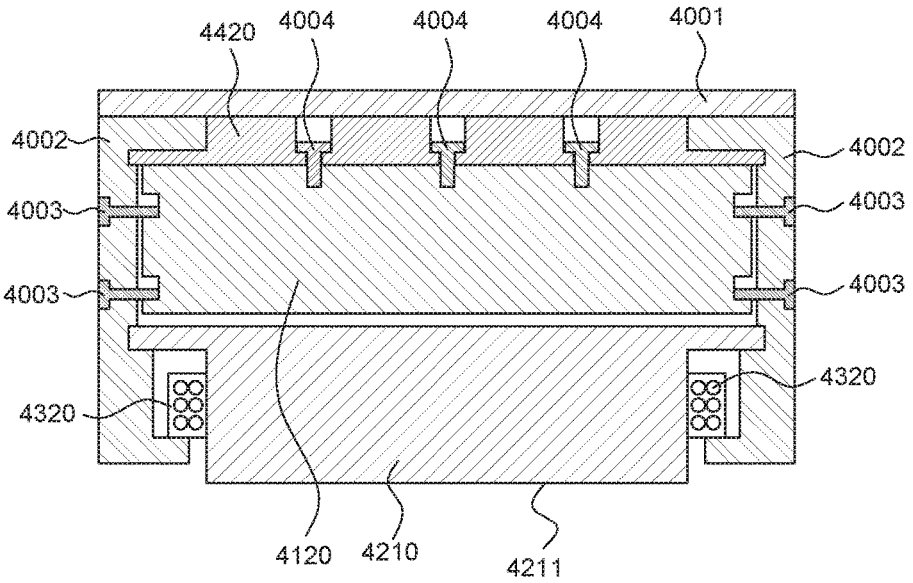
Figure 13:
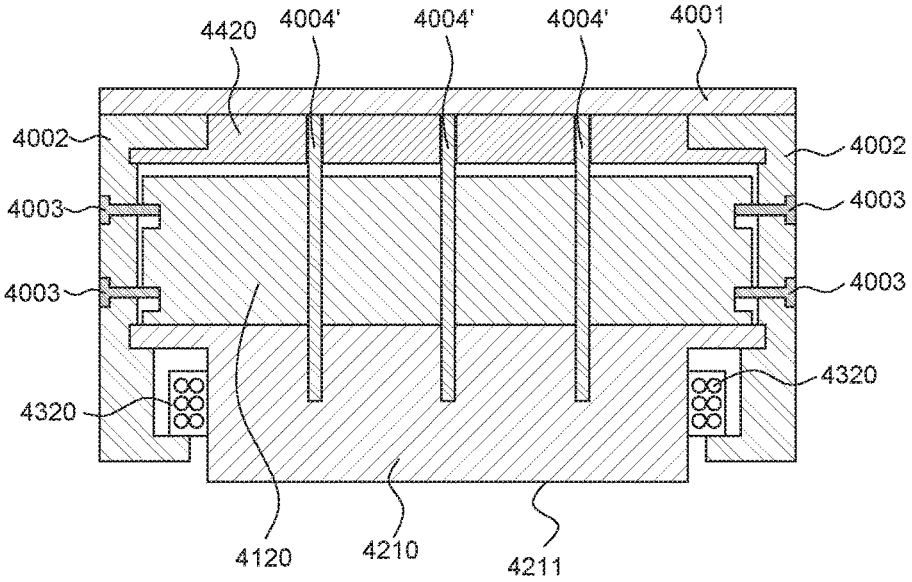
FIG. 13 is a side cross-sectional view of a modification of vertical guide units shown in FIG. 12.

FIGS. 11A and 11B are side cross-sectional views of the magnetic substance holding device of FIGS. 2A to 2C. FIGS. 12A and 12B are side cross-sectional views of the magnetic substance holding device of FIGS. 4A to 4C. FIG. 13 shows a modification of a vertical guide unit of the magnetic substance holding device of FIGS. 12A and 12B.

Referring to FIGS. 11 to 13, the moving mechanism of the first pole piece assemblies 2100 and 4100 will be described in detail.

Referring FIGS. 11A and 11B, in the structure having the holding faces 2421 and 2211 on upper and lower sides, respectively, the first S-pole piece 2120 can be guided by horizontal guide units 2003 inserted in a cover 2002 which is a non-magnetic substance and is installed on the front and rear sides of FIGS. 2A to 2C. An end of each of the horizontal guide units 2003 is inserted in one of holes formed in the first S-pole piece 2120. The first S-pole piece 2120 moves along with the horizontal guide units 2003 inserted in the holes.

The horizontal guide units 2003 guide the movement of the S-pole piece between a location at which the first S-pole piece 2120 is in contact with the second N-pole 2210 as shown in FIG. 11A and a location at which the first S-pole piece 2120 is in contact with the second connection pole piece 2420 as shown in FIG. 11B, so that it is possible to prevent the first pole piece assembly 2100 from deviating when it moves.

Now, referring to FIGS. 12A and 12B, in the structure having the holding face 4211 only on the lower side, vertical guide units 4004 may be further provided, in addition to the horizontal guide units 4003. The vertical guide units 4004 are fixed to the second connection pole piece 4420 and an end of each of the vertical guide units 4004 is inserted into the first S-pole piece 4120.

Referring to FIG. 13, headless bolts which eliminate or minimize the head portions may be used as vertical guide units 4004'. The headless bolts may be installed so that they penetrate the first S-pole piece 4120 and the end of each of the headless bolts may be fixed to the second N-pole piece 4210. With such headless bolts, the area in which magnetic fluxes are formed can be maximized, so that the magnetic substance holding device can have stronger holding force.

On the other hand, referring to FIGS. 11 to 13, it is desired that the stationary pole pieces or the connection pole pieces are inserted into and fixed to the covers 2002 and 4002 so that their movements are minimized in use.

The horizontal guide units 2003 and the vertical guide units 4004 and 4004' are preferably made of a non-magnetic material, and may be applied to all of the above-described embodiments.

According to the magnetic substance holding devices (1000 to 10000) of the present invention, residual magnetism can be minimized when a workpiece is detached. In addition, by disposing coils around pole pieces instead of an additional electromagnet, strong holding force can be obtained in a simple structure, magnetic force from a permanent magnet can be controlled with small current at the time of switching between holding and detaching, and strong holding force can be obtained in a smaller space.

According to the magnetic substance holding device of the present invention, residual magnetism when a workpiece has been detached can be minimized. In addition, by disposing coils around pole pieces instead of an additional electromagnet, strong holding force can be obtained in a simple structure, magnetic force from a permanent magnet can be controlled with small current at the time of switching between holding and detaching, and strong holding force can be obtained in a smaller space.

Although the exemplary embodiments of the present invention have been described with reference to the accompanying drawings, those skilled in the art would understand that various modifications and alterations may be made without departing from the technical idea or essential features of the present invention. Therefore, it should be understood that the above-mentioned embodiments are not limiting but illustrative in all aspects.

What is claimed is:

1. A magnetic substance holding device, comprising:

a first pole piece assembly comprising a first N-pole piece having a holding face and a contact face and being a magnetic substance, a first S-pole piece having a holding face and a contact face and being a magnetic substance, and a first permanent magnet having an N-pole to be in contact with the first N-pole piece and an S-pole to be in contact with the first S-pole piece;

a second pole piece assembly comprising a second N-pole piece having a holding face and a contact face and being a magnetic substance, a second S-pole piece having a holding face and a contact face and being a magnetic substance, and a second permanent magnet having an N-pole to be in contact with the second N-pole piece and an S-pole to be in contact with the second S-pole piece, wherein the contact face of the second S-pole piece faces the contact face of the first N-pole piece, and the contact face of the second N-pole piece faces the contact face of the first S-pole piece;

at least one coil wound around at least one of the first N-pole piece, the first S-pole piece, the second N-pole piece and the second S-pole piece; and a control device controlling current applied to the at least one coil, wherein at least one of the first pole piece assembly and the second pole piece assembly is configured to be movable so that a first arrangement in which the contact face of the first N-pole piece is separated from the contact face of the second S-pole piece and the contact face of the first S-pole piece is separated from the contact face of the second N-pole piece, and a second arrangement in which the contact face of the first N-pole piece is in contact with the contact face of the second S-pole piece and the contact face of the first S-pole piece is in contact with the contact face of the second N-pole piece, are switched between each other, and wherein the control device adjusts current applied to the at least one coil so as to control magnetic fluxes passing through the at least one coil, thereby allowing the first pole piece assembly and the second pole piece assembly to switch between the first arrangement and the second arrangement, to control magnetic fluxes passing through the holding faces of the first pole piece assembly and the second pole piece assembly.

2. The device according to claim 1, further comprising:

a first connection pole piece having a holding face and a contact face and being a magnetic substance; and a second connection pole piece having a holding face and a contact face and being a magnetic substance, wherein the contact face of the first connection pole piece faces the holding face of the first N-pole piece, and the contact face of the second connection pole piece faces the holding face of the first S-pole piece, wherein the first connection pole piece, the second connection pole piece and the second pole piece assembly are stationary whereas the first pole piece assembly is movable between the first/second connection pole pieces and the second pole piece assembly, wherein the first connection pole piece and the second connection pole piece are arranged such that when the first pole piece assembly and the second pole piece assembly are in the first arrangement, the holding faces of the first pole piece assembly are in contact with the respective contact faces of the first connection pole piece and the second connection pole piece, and when the first pole piece assembly and the second pole piece assembly are in the second arrangement, the holding faces of the first pole piece assembly are separated from the respective contact faces of the first connection pole piece and the second connection pole piece, and wherein when the first pole piece assembly and the second pole piece assembly are in the first arrangement, magnetic workpieces are held on the holding faces of the second pole piece assembly and on the holding faces of the first connection pole piece and the second connection pole piece, respectively, and when the first pole piece assembly and the second pole piece assembly are in the second arrangement, magnetic workpieces are detached from the holding faces of the second pole piece assembly and from the holding faces of the first connection pole piece and the second connection pole piece, respectively.

3. The device according to claim 1, further comprising:

a third pole piece assembly comprising a third N-pole piece having a holding face and a contact face and being a magnetic substance, a third S-pole piece having a holding face and a contact face and being a magnetic substance; and a third permanent magnet having an N-pole to be in contact with the third N-pole piece and an S-pole to be in contact with the third S-pole piece, wherein the contact face of the third S-pole piece is arranged to face the holding face of the first N-pole piece, and the contact face of the third N-pole piece is arranged to face the holding face of the first S-pole piece, wherein the second pole piece assembly and the third pole piece assembly are stationary whereas the first pole piece assembly is movable between the second pole piece assembly and the third pole piece assembly, wherein the third pole piece assembly is arranged such that when the first pole piece assembly and the second pole piece assembly are in the first arrangement, the holding faces of the N pole piece of the first pole piece assembly are in contact with the respective contact faces of the third pole piece assembly, and when the first pole piece assembly and the second pole piece assembly are in the second arrangement, the holding faces of the first pole piece assembly are separated from the respective contact faces of the third pole piece assembly, and wherein when the first pole piece assembly and the second pole piece assembly are in the first arrangement, a magnetic workpiece is held on the holding faces of the second pole piece assembly whereas a magnetic workpiece is detached from the holding faces of the third pole piece assembly, and when the first pole piece assembly and the second pole piece assembly are in the second arrangement, a magnetic workpiece is detached from the holding faces of the second pole piece assembly whereas a magnetic workpiece is held on the holding faces of the third pole piece assembly.

* * * * *